United States Patent [19]

Patterson,

[11] Patent Number: 5,058,887

[45] Date of Patent: Oct. 22, 1991

[54] HYDRAULIC EXERCISE APPARATUS

[76] Inventor: Gary W. Patterson, 1446 C.R. 234, Durango, Colo. 81301

[21] Appl. No.: 450,317

[22] Filed: Dec. 14, 1989

[51] Int. Cl.[5] ..... A63B 21/008

[52] U.S. Cl. ..... 272/130

[58] Field of Search ..... 272/130, 134, 143, 117

[56] References Cited

U.S. PATENT DOCUMENTS

| | | | |
|---|---|---|---|
| 3,369,403 | 2/1968 | Carlin et al. . | |
| 3,822,599 | 7/1974 | Brentham . | |
| 3,858,873 | 1/1975 | Jones | 272/117 |
| 3,912,265 | 10/1975 | Muir . | |
| 4,241,913 | 12/1980 | Zwayer et al. | 272/130 |
| 4,291,787 | 9/1981 | Brentham . | |
| 4,353,547 | 10/1982 | Jenkinson . | |
| 4,397,462 | 8/1983 | Wilmarth . | |
| 4,465,274 | 8/1984 | Davenport . | |
| 4,482,152 | 11/1984 | Wolff . | |
| 4,576,377 | 3/1986 | Wolff . | |
| 4,618,140 | 10/1986 | Brown . | |
| 4,627,610 | 10/1986 | Ishada et al. . | |
| 4,645,205 | 2/1987 | Wolff | 272/134 X |
| 4,651,986 | 3/1987 | Wang . | |
| 4,667,955 | 5/1987 | Giesch . | |
| 4,728,101 | 3/1988 | King | 272/130 |
| 4,754,964 | 7/1988 | Michaels | 272/130 X |
| 4,848,739 | 7/1989 | Schaub et al. | 272/130 X |
| 4,867,445 | 9/1989 | Connelly | 272/130 |
| 4,911,436 | 3/1990 | Lighter | 272/130 |

FOREIGN PATENT DOCUMENTS

| | | | |
|---|---|---|---|
| 2593071 | 7/1987 | France | 272/130 |

*Primary Examiner*—Robert Bahr

[57] ABSTRACT

A hydraulic exercise apparatus includes a hydraulic pump for pumping fluid through a fluid circuit in response to movement of an exercise member along an exercise stroke in such a manner that the force required to move the exercise member is dependent upon the pressure of fluid pumped. The fluid circuit includes valve means for allowing fluid to flow through the circuit only when a fluid pressure exceeds a selected pressure. The hydraulic exercise apparatus further includes pressure selection means for determining the selected pressure in accordance with the position of the exercise member along the exercise stroke.

34 Claims, 22 Drawing Sheets

HYDRAULIC EXERCISE APPARATUS

TECHNICAL FIELD

The present invention relates to apparatus to facilitate the exercising of muscles for cardiovascular and aerobic exercise and to enhance muscle development. More specifically, the present invention relates to apparatus for providing resistive forces against which muscles of the human body may be dynamically exercised in a variety of exercise patterns to selectively enhance their growth and development. Most particularly the present invention relates to universal gym type exercise devices which provide those resistive forces by means of hydraulic cylinders for a large number of different exercises.

BACKGROUND OF THE INVENTION

In recent years, increased recognition of the many benefits of cardiovascular and aerobic exercise and body conditioning, in combination with continually increasing time constraints of modern lifestyles, have resulted in a large demand for exercise devices which can provide maximum benefits of exercise with a minimum of inconvenience and minimum time requirement. This demand has resulted in the development of numerous types of exercise machines and systems.

Exercise machines and systems may be categorized based upon the method and medium utilized to provide a resistive force against which the muscles are worked and the configuration of the structural elements of the apparatus through which the user athlete interfaces with the resistive medium. Prior to the advent of modern exercise machines and universal gyms, iron weights lifted against gravity were the most common resistance medium. Iron bars, used in combination with the weights as bar bells or dumb bells, were the apparatus which allowed the athlete to work his muscles in an appropriate manner against appropriate weight for selected enhancement of muscle development. Auxiliary apparatus, such as benches and weight racks, assisted in the positioning of the athlete's body relative to the orientation of gravity as appropriate. Such "free weight" exercise apparatus has many disadvantages. There is an ever present danger associated with the use of this equipment that a user athlete will loose control of the weight due to fatigue of the athlete's muscles or an attempt to lift more weight than the athlete's muscles are capable of controlling. Much time is required for changing weights and moving weights and auxiliary equipment to prepare for different exercises. Equipment for an extensive and thorough fitness program constitutes a great number of separate parts, i.e. weights, bars and auxiliary equipment, to be organized and stored.

Many contemporary exercise and universal gym devices continue to use iron weights, or weights made of other suitably dense material, to provide resistance for muscle exercise while attempting to overcome the dangers and inconvenience of free weight exercise apparatus. These devices confine the weights to movement along fixed tracks to eliminate dangers associated with loss of control and dropping of free weights during attempts to work the muscles against too great a force. The weights of these apparatus are connected by chains, levers and the like, in various configurations, to exercise members which are engaged and worked in a cyclical fashion during muscle conditioning exercises by the user athlete. These machines, however, also suffer from a number of disadvantages. First, they must be massive to provide the weight necessary for training advanced athletes and to provide the structural strength necessary to support and control that weight. Also, they are complex because all exercising motions must be translated into up and down movement of the weights along their tracks in the gravitational field. This latter consideration generally precludes the provision of an exhaustive selection of conditioning exercises by one such machine and necessitates the use of multiple machines for a complete fitness program.

Efforts to reduce the great mass associated with weight resistance devices and to free the design of exercise machine and universal gym structures from the constraints of orienting the movement of the resistance medium to an alignment with gravity, have lead to the development of a number of exercise devices based upon hydraulic resistance. While machines of this type differ in their hydraulic system design and their structural configuration for providing the interface between the user athlete and the hydraulic resistance system, the hydraulic systems of all these apparatus generally have two key elements in common; a hydraulic cylinder with a piston linked to an exercise member and arranged to pump fluid in and out of the cylinder in response to movement of the exercise member through an exercise cycle, and a static and/or dynamic flow resistance means for creating a resistive pressure in the cylinder against which the muscles are worked. Despite the large number of such machines known in the art, all are deficient in one or more respects.

Most hydraulic exercise apparatus heretofore known in the art utilize double-action hydraulic cylinders. The utilization of double-action hydraulic cylinders in many of these devices results in multi-directional resistance. That is, unlike exercise with free weights, exercising forces are provided by double-action cylinder devices which resist movement of the exercise member during both an exercise stroke and a return stroke of an exercise cycle. Due to this "two-way resistance", these devices fail to provide the benefits of muscle exercise which may be obtained with "free weight" exercising apparatus which do not provide a resisting force during the return stroke. Double-action cylinders are more complex and costly than single-action hydraulic cylinders, and are generally weaker than single action hydraulic cylinders of similar cost and size. Thus, in devices using double-action cylinders, the cylinders must be located further from fulcrum points requiring larger structures than can be provided by exercise devices utilizing single-action cylinders.

Many hydraulic exercise devices of the present art also lack sufficient configuration adaptability to provide a full range of individual muscle toning exercises necessary for true muscle conditioning program versatility. Further, few of these devices have structures which can fold into a compact configuration for ease of storage and transport. Adjustment of the level of exercising resistance provided by these devices is often cumbersome and, generally, the resistances can not be directly set in pounds. None of these devices provide for controlled variation of hydraulic resistance over the exercise stroke to provide for optimum exercise benefit. Many of these machines utilize designs requiring the use of multiple hydraulic cylinders in order to allow a reasonable number of different exercises to be accomplished with the aid of only that single machine, further increasing its mass and complexity. None of the hydraulic resistance exercise machines and universal gyms of the prior art have achieved great versatility of exercise configuration in combination with a structure sufficiently light and simple to allow those exercise machines and universal gyms to be readily and conveniently transported between different locations.

DISCLOSURE OF THE INVENTION

It is an object of the present invention to provide a versatile exercise apparatus utilizing a hydraulic resistance medium, which can provide benefits of exercise obtainable with "free weight" exercise apparatus.

Another object of the present invention is to provide an exercise apparatus which is light in weight and portable.

It is further object of the present invention to provide exercise resistance and orientation which can be quickly changed to allow a large number of beneficial exercises to be accomplished with a single machine.

It is yet a further object of the present invention to provide an exercise apparatus which has a minimum number of component parts.

It is a still further object of the present invention to provide an exercise apparatus which provides a resistive force only during the exercise stroke of an exercise cycle and little or no resistive force during the return stroke of an exercise cycle to more closely emulate "free weight" exercise apparatus.

It is an additional object of the present invention to further emulate "free weight" exercise apparatus by allowing exercising movement along an exercise stroke only when an exercising force is exerted by the user athlete which exceeds a minimum exercising force.

It is yet another object of the present invention to allow emulation of "free weight" exercise apparatus by maintaining a constant exercising force throughout the exercise stroke.

It is a further object of the present invention to allow selective control of the exercise resistance over the exercise stroke for maximum exercise benefit.

It is also an object of the present invention to allow the level of exercise resistance to be quickly and easily changed.

It is yet another object of the present invention to provide an exercise apparatus of minimum mass to facilitate transport of the apparatus.

Yet another object of the present invention is to provide an exercise apparatus having a minimum number of components and which may be readily disassembled or folded for transport or storage.

It is still a further object of the present invention to provide an exercise apparatus which is adaptable to fold into a compact self-contained package for storage and transport.

It is yet another object of the present invention to prove an exercise apparatus which is strong and compact so as to occupy a minimum of space when assembled in exercise configuration.

It is a still further object of the present invention to provide an exercise apparatus having few moving parts.

It is an additional object of the present invention to provide an exercise apparatus which is economical to manufacture.

In accordance with the above objectives, an exercise apparatus including a preferred embodiment of the present invention includes a hydraulic pump, in the form of a single sided hydraulic cylinder having an actuator and a piston, for pumping fluid through a fluid circuit in response to a pumping movement of the actuator such that the force required to cause the pumping movement of the actuator is dependent upon the pressure of the fluid pumped. An exercising member, upon which the user athlete exerts an exercising force, is provided which is movable from an initial position through an exercise cycle including an exercise stroke and a return stroke, respectively, to return to the initial position. The exercise member is linked to the actuator of the hydraulic cylinder pump in such a manner that the exercise member may move along the exercise stroke only by causing pumping movement of the actuator. A fluid circuit in fluid communication with the hydraulic cylinder pump has first fluid valve means for allowing fluid to flow from the pump, through a first portion of the fluid circuit, only when a fluid pressure at the upstream side of the first fluid valve means exceeds a selected pressure such that the exercise member can be moved along the exercise stroke only by exerting an exercising force exceeding a force corresponding to the selected pressure. An exercise apparatus comprising a preferred embodiment of the invention further includes pressure selection means for determining the selected pressure in accordance with the position of the exercise member along the exercise stroke.

The fluid circuit may further comprise a second fluid valve means for allowing fluid to flow freely through a second portion of the fluid circuit only during the return stroke so that no exercising force is required to move the exercise member thorough the return stroke. The means for determining the selected pressure may include a linear or rotary cam linked to move in proportion to movement of the piston of the hydraulic cylinder pump and control the biasing force with which a valve element of the first fluid valve means is held against the upstream pressure.

An exercise apparatus including a preferred embodiment of the present invention includes a vertical support member and a carrier which may be fixed in various positions along an axis of the support member. First and second lever member are pivotally attached to the carrier to pivot in a common plane with the support member axis and extend outwardly and away from the support member to embrace a hydraulic resistance member therebetween. The resistance member has first and second ends which are attached to the first and second lever member respectively. An immobilizing member, hingidly attached to the carrier, may be releasably attached to a selected one of the lever members to immobilize it.

Other objects, advantages and aspects of the invention will become apparent upon reading of the following detailed description and claims and upon reference to the accompanying drawings.

DETAILED DESCRIPTION OF THE INVENTION

Figure 1:
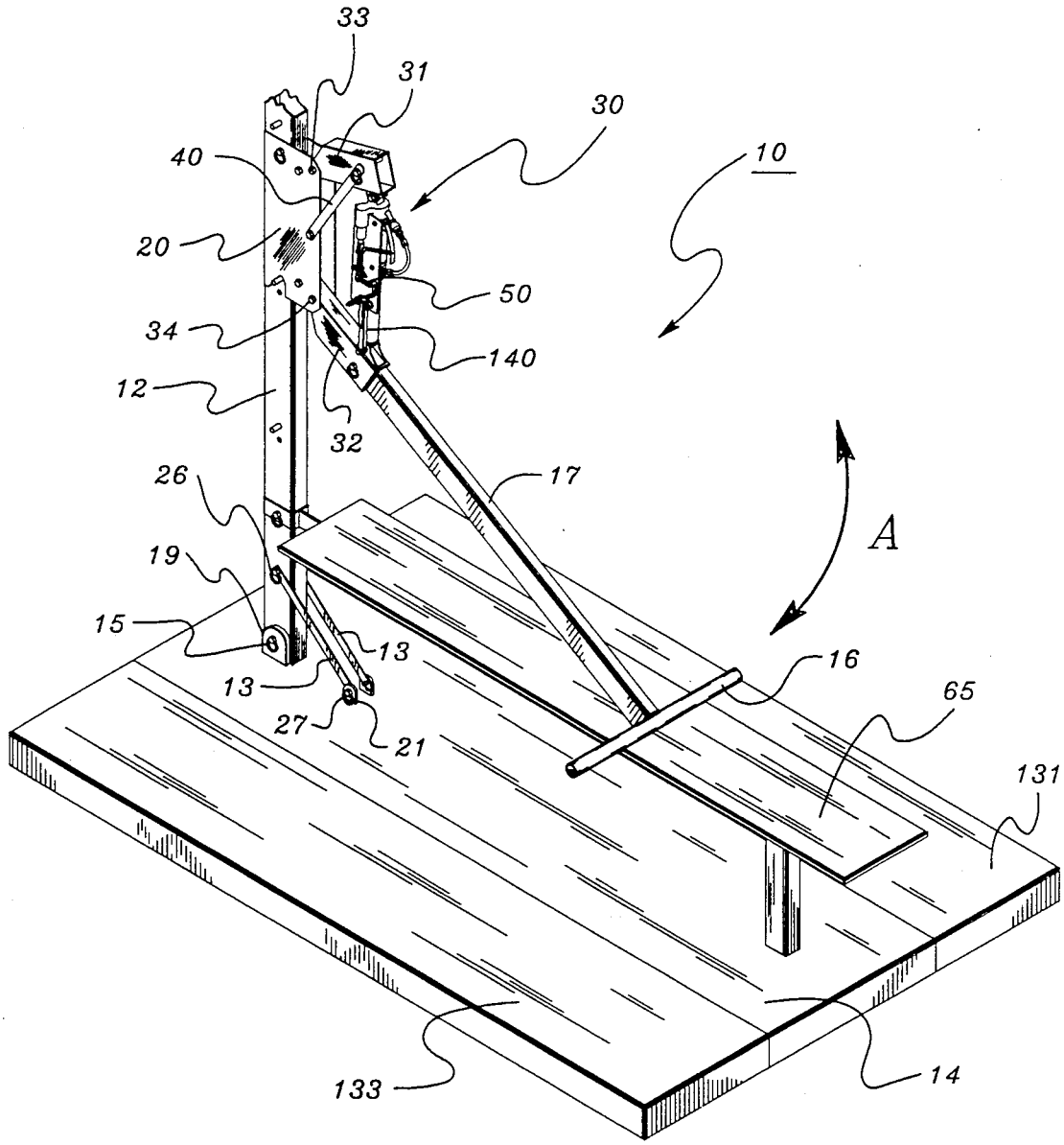
FIG. 1 is an isometric pictorial view of a hydraulic exercise apparatus comprising a preferred embodiment of the present invention.

A hydraulic exercise apparatus 10 comprising a preferred embodiment of the invention is shown in FIG. 1. Exercise apparatus 10 comprises support member 12 pivotally mounted on an exercise apparatus base !4 at 15 and held rigidly in a vertical position by releasable support struts 13. Hydraulic resistance assembly 30 is mounted on support member 12 by means of carrier 20. As may best be seen in FIG. 2, in addition to carrier 20, hydraulic resistance assembly 30 includes first and second lever members 31, 32 which are rotatably attached to carrier 20 at pivot points 33, 34, respectively. Lever members 31, 32 extend outwardly and away from support member 12 and carrier 20 to distal free ends and embrace hydraulic resistance member 50, which is pivotally attached to lever members 31, 32 at 51, 52, respectively. Lever members 31, 32 may pivot about pivot points 33, 34, respectively, in a common plane with one another and support member 12.

Figure 29:
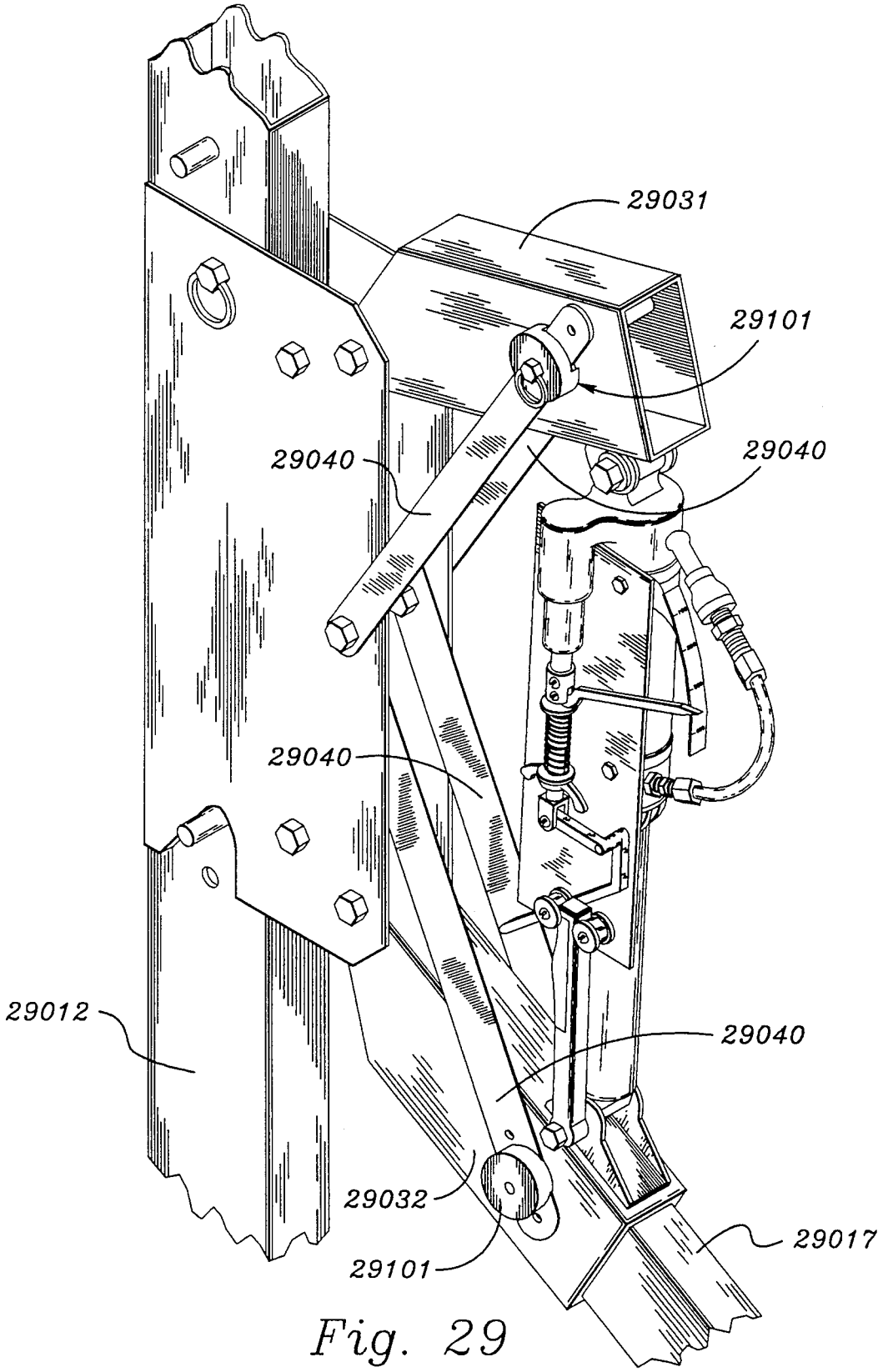
FIG. 29 is an isometric pictorial view of the hydraulic resistance assembly of an alternative embodiment of the present invention.

In the embodiment of FIG. 1, immobilizing member 40 is rotatably attached to carrier 20 at pivot point 41 located midway between lever attachment points 33 and 34. Immobilizing member 40 of the exemplary exercise apparatus may be selectively and releasably attached to one of lever members 31, 32 by means of immobilizing pin 42 by passing immobilizing pin 42 through aligning holes in immobilizing member 40 and the selected lever member, respectively, to immobilize the selected lever member. While, in the illustrations of FIGS. 1 and 2, first lever member 31 is immobilized by attachment of a single immobilizing member 40, an immobilizing member may be provided on each side of the resistance assembly for increased strength in which case both immobilizing members may be attached to the selected lever member by a common immobilizing pin passing completely through the selected lever member. Multiple holes may be provided in immobilizing member 40 and/or lever members 31, 32 to allow the lever members to be immobilized in varied positions. Further, a pair of immobilizing members may be provided for each of lever members 31,32, as in the embodiment of FIG. 29. In that embodiment, each of the immobilizing members 29040 are pivotally attached at a near end to carrier 29020 ar 29041 and slidably restrained at a distal end by centering device 29101. As may be seen in FIG.

30, centering device 29101 includes rotatable member 29102 with inner groove 29113 sized to slidably receive immobilizing member 2940. Rotatable member 29102 is rotatably retained against a side of lever member 29031 in such a manner as to slidably confine a portion of immobilizing member 29040 proximate to its distal end in groove 29103 by cap 29104 which is attached to lever member 31 at bases of support legs 29106, for example, by welding. When immobilizing pin 29042 is passed through aligning hole 29105 of centering device 29101 and aligning holes in immobilizing member 29041 and lever member 29031, immobilizing member 29031 is immobilized. With immobilizing pin 29042 removed, the distal end portion of immobilizing member 29040 may slide freely in centering device 29101 to allow lever member 29031 to rotate freely about pivot point 29033. Those familiar with the art will recognize that other means for immobilizing the selected lever member which are well know in the art may be adapted, for example, aligning pin holes might be provided in base member 20 and lever members 31, 32 through which immobilizing pins could be inserted, or helical thread friction locks might be provided at pivot points 33, 34.

Figure 2:
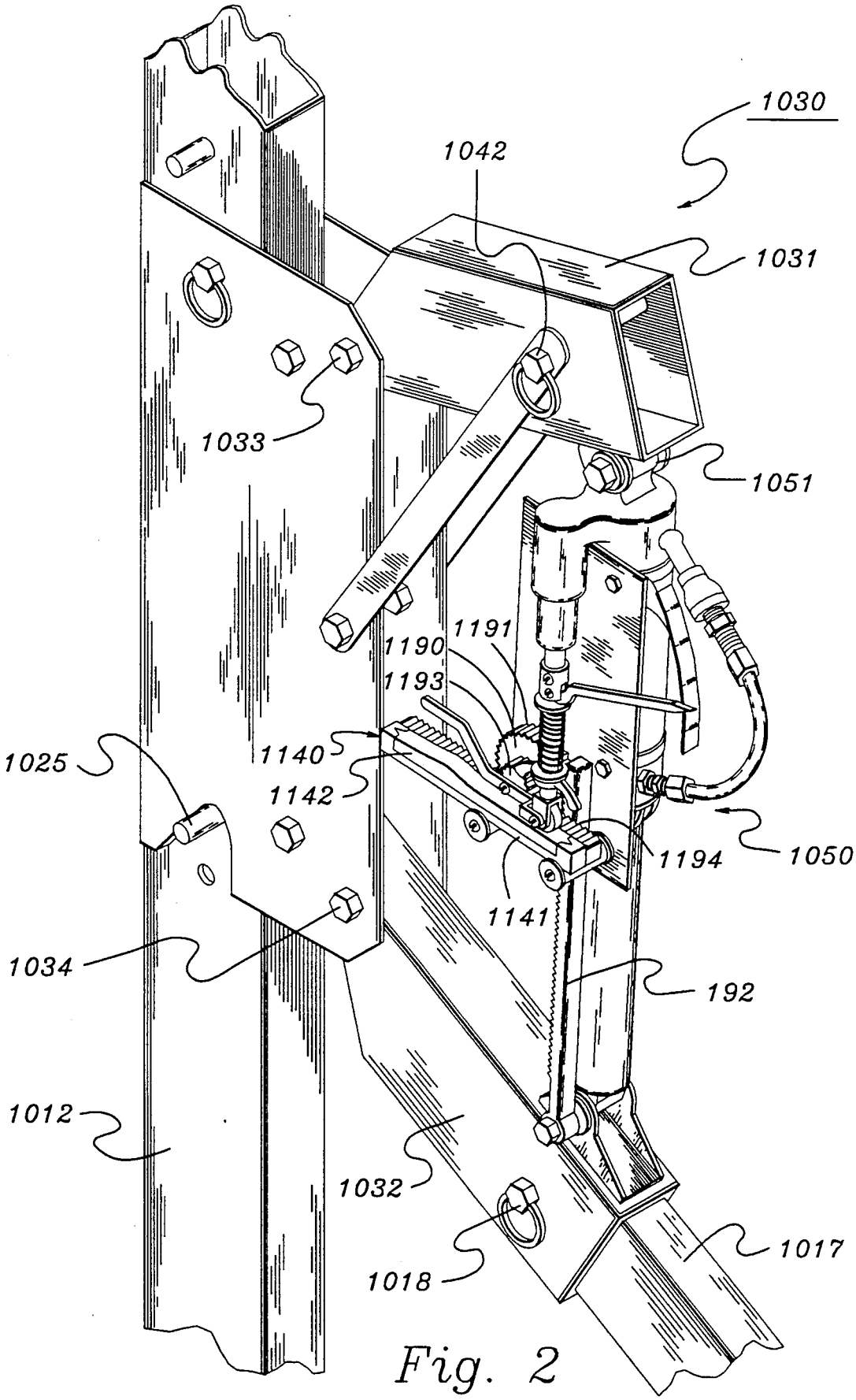
FIG. 2 is an isometric pictorial view, in close-up, of the hydraulic resistance assembly of the apparatus of FIG. 1.

Lever members 31, 32 are preferably formed as hollow beams to facilitate attachment of devices, such as extension member 17 shown in FIG. 1, and are fabricated of a material of suitable rigidity and strength. In FIGS. 1 and 2, rigid extension member 17 is shown inserted into lever member 32 and held in place by extension member attachment pin 18. Attachment pin 18 is passed through aligning holes in extension member 17 and lever member 32 to retain the base end of extension member 17 within the hollow interior of lever member 32. Once attached to hydraulic resistance assembly 30 in this manner, extension member 17 extends outwardly from hydraulic resistance assembly 30 to a distal end to which exercise member 16 is attached.

Figure 3:
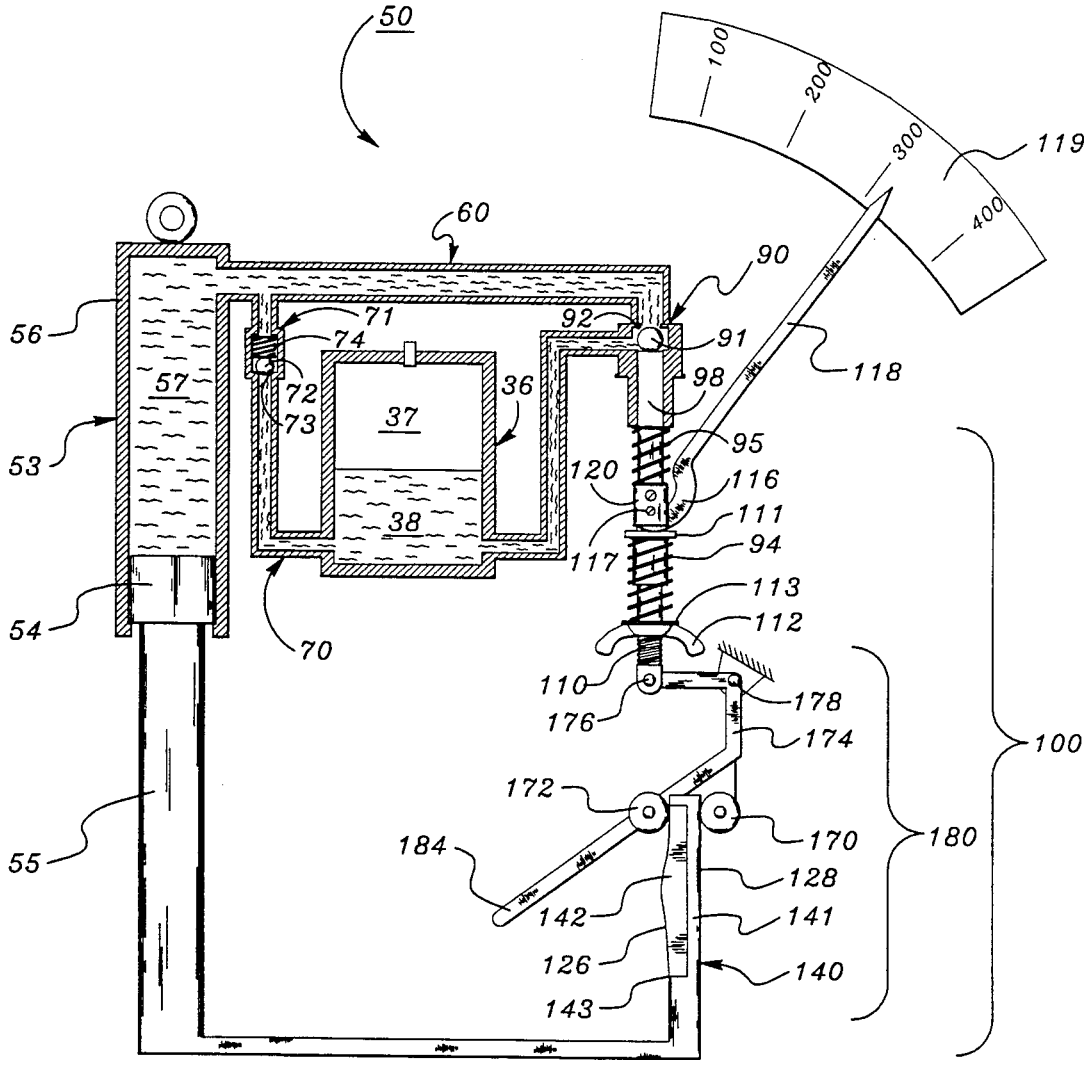
FIG. 3 is a schematic representation of the fluid circuit of a hydraulic resistance member of a hydraulic exercise apparatus comprising a second embodiment of the present invention.

As may best be seen in the schematic illustration of a second embodiment of the present invention of FIG. 3, hydraulic resistance member 30 includes a single sided hydraulic cylinder 53 having piston 54 slidably retained in housing 56 to form hydraulic chamber 57. Hydraulic chamber 57 of hydraulic cylinder 53 of resistance member 50 is in fluid communication with fluid circuit 60 which includes a reservoir 36 for containing a variable amount of hydraulic fluid 38. When sufficient longitudinal force is exerted upon actuator portion 55, piston 54 is caused to slide longitudinally within housing 56, decreasing or increasing the volume of hydraulic chamber 57 to pump hydraulic fluid from chamber 57 through fluid circuit 60 to reservoir 61, or to draw fluid from reservoir 61 through fluid circuit 60 into chamber 57, respectively.

Referring to FIG. 1, it will now be understood that, with lever member 31 immobilized by attachment of immobilizing member 40, when exercise member 16 is moved upward and downward by a user athlete through an exercise cycle, along an arc as, indicated by arrow A in FIG. 1, piston 54 is caused to move longitudinally within housing 56, decreasing and increasing the volume of chamber 57 to pump fluid into reservoir 61 and draw fluid from reservoir 61, respectively. Further, the force which must be exerted upon exercise member 16 to move member 16 through the exercise cycle will be proportional to the gauge pressure of the hydraulic fluid within hydraulic chamber 57.

Fluid circuit 60 includes a first fluid passage 80, leading from chamber 57 to reservoir 61, and a second fluid flow passage 70, leading from reservoir 61 to pressure chamber 57. Check valve 71 is interposed in second fluid passage 70 to allow fluid to flow through second fluid passage 70 only in the direction from reservoir 61 to chamber 57. Check valve 71 may be any of the many types of check valves well known in the art. As illustrated in FIG. 3, in exemplary exercise apparatus 10, check valve 71 is a ball type check valve comprising ball element 72 which is held lightly against seat 73 by check valve spring 74.

Pressure control valve 90 is interposed in first fluid flow passage 80, and, in the preferred embodiment, comprises spherical valve element 91 which is urged against seat 92 by valve spring 94 acting through pushrod 98. Thus, pressure control valve 90 will allow fluid to flow from chamber 57, through first fluid flow passage 80 to reservoir 61, only when the fluid pressure in chamber 57, upstream of pressure control valve 91, exceeds the pressure in reservoir 61, downstream of pressure control valve 91, by an amount sufficient to lift element 91 from seat 92 in opposition to the seating force exerted upon element 91 by pushrod 98. Valve seat 92 is of sufficient size to allow fluid to flow freely when the seating force is overcome.

The amount by which the hydraulic pressure in chamber 57 must exceed the pressure in reservoir 61 before fluid may flow from chamber 51 to reservoir 61 is determined by control assembly 100. As discussed above, in exemplary exercise apparatus 10 of FIG. 3, the biasing force which urges valve element 91 against seat 92 is provided by valve spring 94. In the embodiment of FIG. 3, valve spring 94 is a helical spring rounding threaded adjustment rod 110 and is compressed between valve side spring support 111 and base spring support 113. The upper end of adjustment rod 110 is inserted telescopically into a cylindrical cavity in pushrod 98 and is sized to slide freely within the cavity. Base spring support 113 surrounds adjustment rod 110 and is sized to move freely longitudinally along a portion of its length. Wing nut 112 is provided with internal threads to cooperate with the threads of adjustment rod 110 to allow adjustment base spring support 113 to vary the compression length of valve spring 94 and thus the nominal biasing force exerted by valve spring 94 upon push rod 98 and valve element 91. Valve side spring support 111 surrounds adjustment rod 110, and may move freely longitudinally along a portion of its length. Selection cam 116 is pivotally attached at 117 to selection cam support 120 mounted on the lower end of pushrod 98, and may be rotated about pivot point 117 by means of adjustment lever 118. Selection cam 116 acts against valve side spring support 111 to hold valve side spring support 111 against the force of valve spring 94 at a selected longitudinal position along adjustment rod 110. In this manner, valve side spring support 111 may be moved along the axis of helical spring 94 to select a base level biasing force which holds valve element 91 against valve seat 92. An index scale, 119, may be provided to cooperate with adjustment lever 118 to indicate the magnitude of the base level bias force applied to valve element 91. Scale 119 may indicate the base level effort required to lift valve element 91 and cause fluid to flow through second fluid passage 70 in terms of pressure differential over valve 90, pounds of force which must be applied to exercise element 16, or merely relative to an arbitrarily chosen biasing force. Thus, wing nut 112 allows adjustment of the compression length of spring 94 to provide long term adjustment of scale 119 by adjustment of the nominal biasing force. Also, because spring 94 is located externally of the fluid circuit, stronger or weaker springs may readily be substituted to increase the possible range of adjustment of the nominal biasing force. Releasably attachable scales, such as adhesive backed or snap-on cards, may be utilized to provide appropriate scale ranges for different springs. Weak relief spring 95 may be provided to assure spherical element 91 becomes unseated when wing nut 112 and cam 116 are adjusted for zero threshold force to allow the position of lever members 31, 32 to be readily adjusted when folding the apparatus for storage or transport, as discussed below.

With selection lever 118 set at the desired position relative to scale 119, when exercise member 16 of the exercise apparatus 10 is engaged by a user athlete and urged upwardly against an exercising force, a force is transmitted by extension member 17 and lever member 32 to actuator portion 55 of piston 54 at attachment point 52 to increase the pressure of the hydraulic fluid in chamber 57. However, no motion of exercise member 16 can occur until the pressure of the hydraulic fluid in chamber 57 becomes sufficient to cause fluid to flow from chamber 57 through first fluid passage 80 of fluid circuit 60 to reservoir 61. Once the user athlete has applied sufficient exercising force upon exercise member 16, exercise member 16 will move through an exercise stroke providing a constant exercising force while causing fluid to be pumped from chamber 57 to reservoir 61. When the user athlete of exercise apparatus 10 moves exercise member 16 through a return stroke, increasing the volume of chamber 57, pressure control valve 90 acts as a check valve, sealing against seat 92 to prevent return of fluid from reservoir 61 to chamber 57 through first fluid flow passage 80. However, as piston 54 is moved downward during the return stroke, check valve 71 will open to allow fluid to return to chamber 57 from reservoir 61 through second fluid flow passage 70 with very little pressure drop, thus requiring only very little force to be exerted on exercise member 16 during the return stroke. Thus, exercise apparatus 10, comprising the preferred embodiment of the present invention, allows independent exercise of the individual muscle groups as with free weight exercise apparatus and separates periods of high exertion exercise strokes with low effort return strokes. The benefits of such exercise are generally recognized by those familiar with the art to be greater than those obtainable by alternately exercising muscle groups through both high effort exercise and return strokes, as is generally the case when double action hydraulic devices are used.

Gas 37 above hydraulic fluid 38 in reservoir 36 may be at a pressure greater than atmospheric pressure to assist the flow of fluid back to hydraulic chamber 57 through second flow passage 70 during the return stroke. So long as the volume of gas 37 above hydraulic fluid 38 in reservoir 36 is sufficiently large, gas 37 and fluid 38 in reservoir 36 will remain at a generally constant pressure though the volume of fluid 38 may increase and decrease. In the embodiment of FIG. 3, vent 39 is provided to comunicate with the atmosphere and maintain the pressure of gas 37 at atmospheric pressure.

Hydraulic exercise apparatus 10 comprising the exemplary preferred embodiment of the invention provides for further adjustment of the biasing force exerted by valve spring 94 upon valve element 91, and thus the exercising force required to move exercise member 16, continuously, throughout the exercise stroke. This feature may be utilized to maximize the benefits of certain exercise cycles by varying the exercise force during the exercise stroke, or to compensate for changing mechanical advantage of a user athlet's musculoskeletal structure as well as the structure of exercise apparatus 10 during the exercise stroke of some exercise routines to require a constant level of exertion by the user athlete's muscles throughout the exercise stroke.

Figure 5:
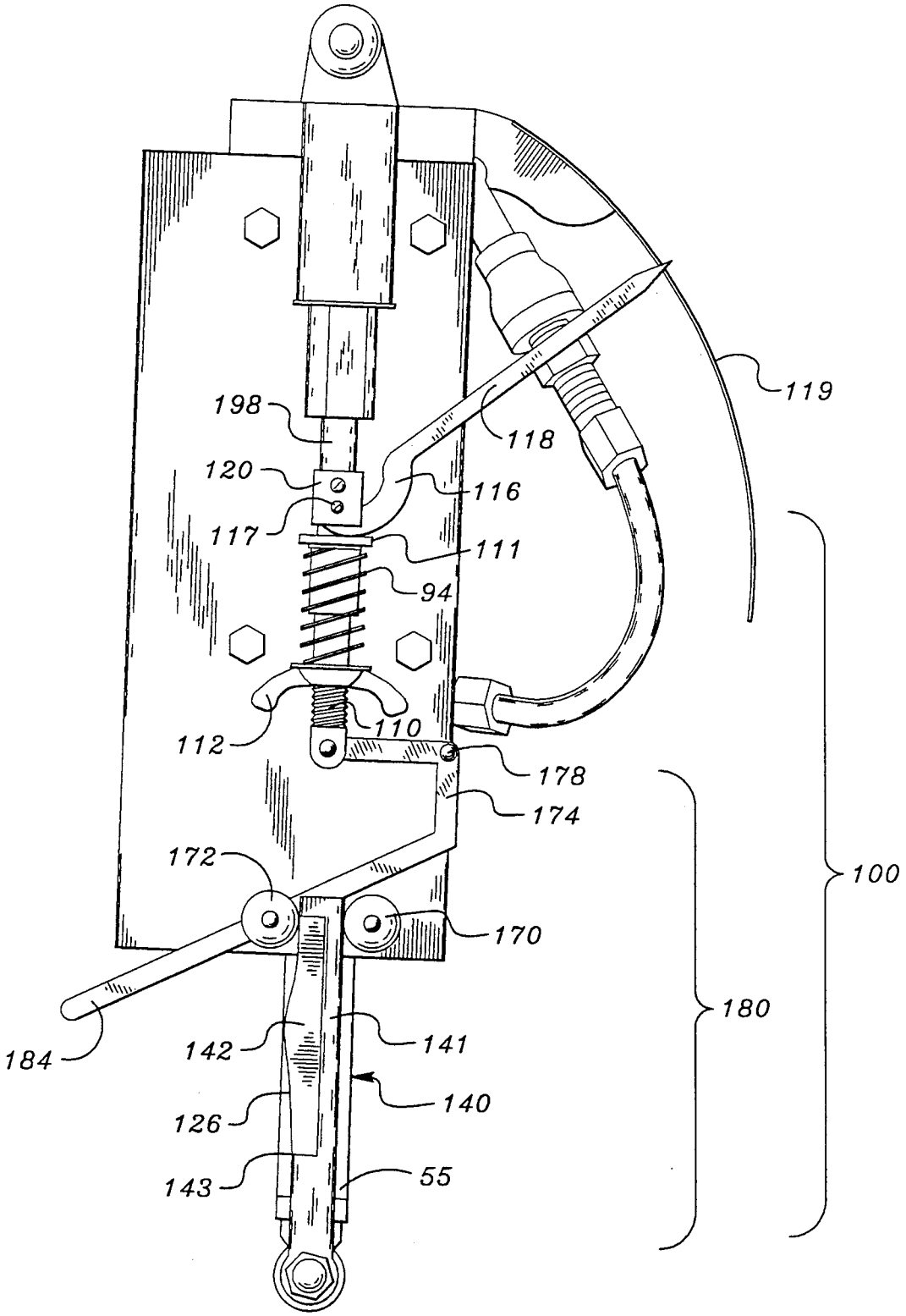
FIG. 5 is a side elevation of the hydraulic resistance member of an exercise apparatus comprising the embodiment of FIG. 3.
Figure 6:
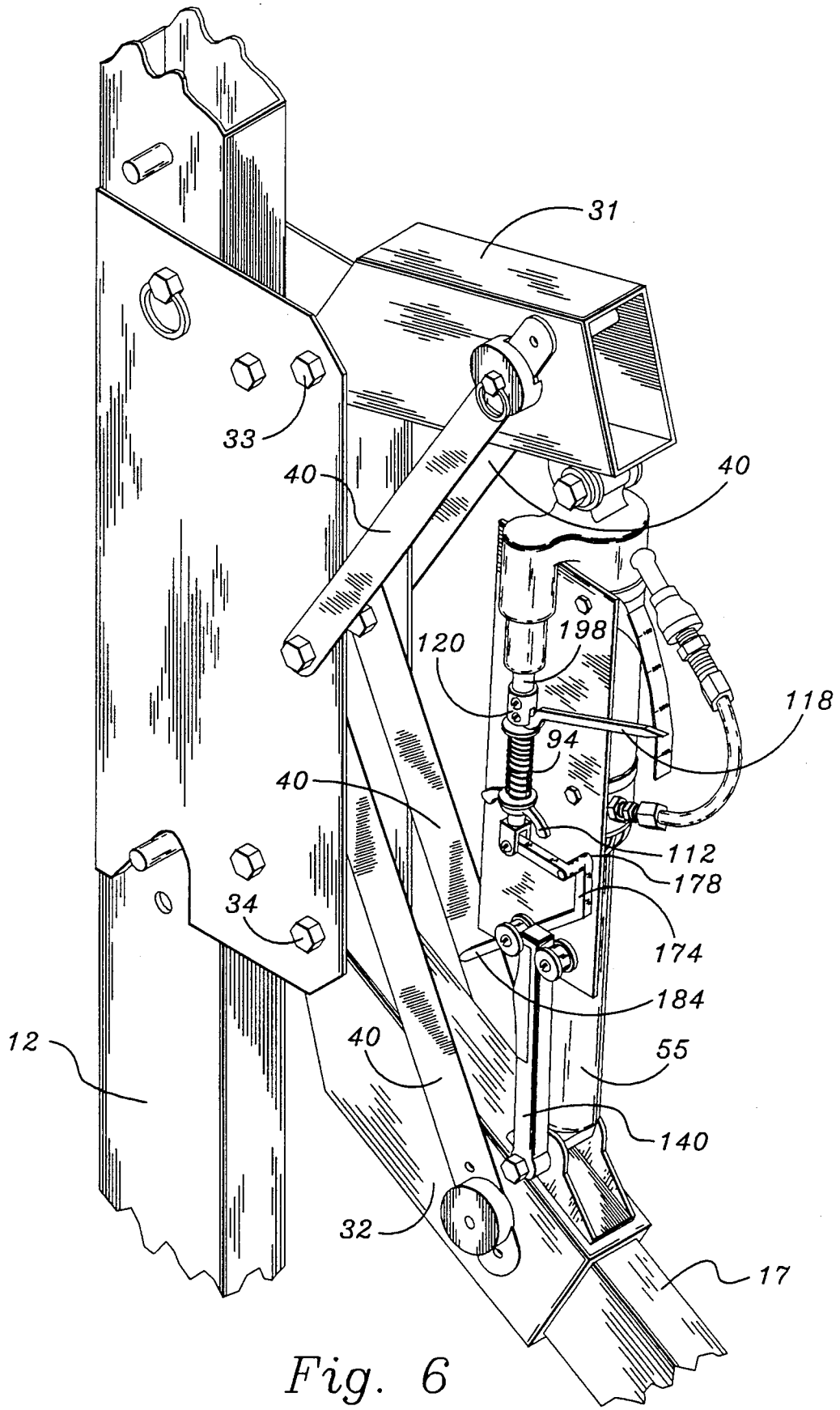
FIG. 6 is an isometric pictorial view, in close up, of the hydraulic resistance assembly of the exercise apparatus of FIG. 3.

As may be seen in FIGS. 3 and 5, in exercise apparatus 10 comprising the second embodiment of the present invention, control of the exercise force during the exercise stroke is accomplished by exercising force control cam 140 and linkage assembly 180. In the exemplary preferred embodiment, cam 140 is a linear cam which is mechanically linked to actuator portion 55 of piston 54 to move proportionally with movement of exercise member 16. Linear cam 140 includes a carriage portion 141 and a control portion 142, and lies between support roller 170 and follower roller 172. Control portion 142 is removably insertable in carriage portion 141 and control portions having control surfaces 126 of differing exercising force control profiles may be substituted as appropriate for differing exercise use. Follower roller 172 is linked to adjustment rod 110 by bellcrank member 174 upon which follower roller 172 is rotatably mounted. Linking member 174 is pivotally mounted at fulcrum point 178 and pivotally attached to the base of adjustment rod 110 at 176. Thus, following roller 172 is held against control surface 126 of control portion 142 by the biasing force of valve spring 91. As actuator 55 and piston 54 move through an exercise stroke, linear cam 140 will move longitudinally between support roller 170 and follower roller 172, and, at each point along the exercise stroke, the distance between the support roller 144 and follower roller 172 will be determined by the local width of cam 140 as determined by the contour of control surface 126. Thus, adjustment rod 110 will be moved telescopically within pushrod 98, changing the compression length of spring 94 and, thus, the biasing force applied to pushrod 98 and the magnitude of the exercising force necessary to move piston 54 to decrease the volume of chamber 57. For example, as the distance between rollers 144 and 172 is increased, linking member 174, as shown in FIG. 3, is caused to rotate clockwise and cause adjustment rod 110 to telescope upward into pushrod 98, shortening spring 94 and increasing the biasing force acting on valve element 91 and the exercising force which must be exerted on the exercise member 16 to move it along the exercise stroke. Different control portions 142 having different exercising force control profiles of surface 126 may be inserted into carrier portion 140 to alter the pattern of resistance during the exercise stroke of hydraulic exercise apparatus 10 as desired. A lift handle 184 is provided as an extension of member 174 to allow follower roller 172 to be raised from control surface 126 to facilitate removal and replacement of control portions 142.

Figure 4:
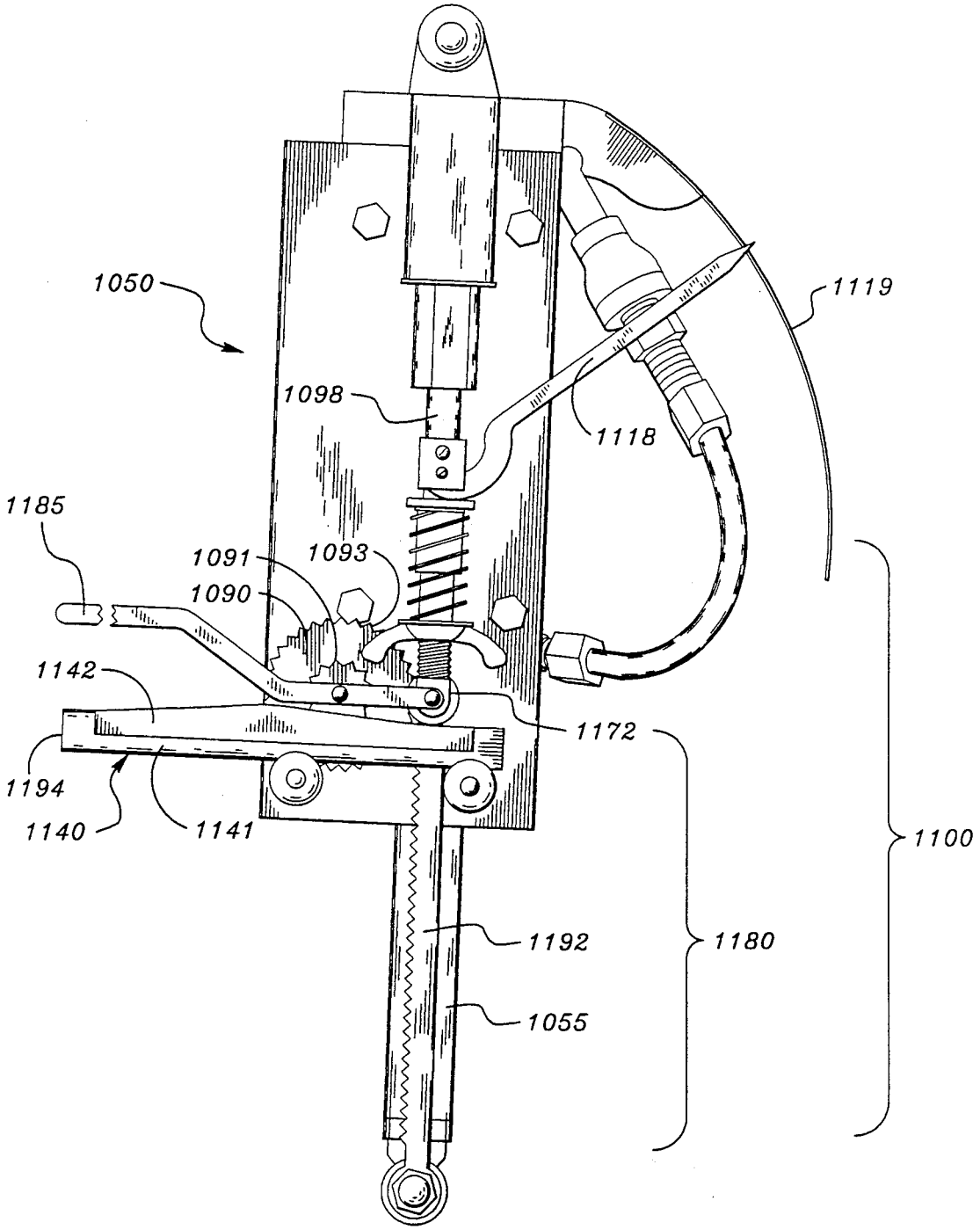
FIG. 4 is a side elevation of the hydraulic resistance member of the exercise apparatus comprising the embodiment of FIG. 1.

As may be seen in FIGS. 2 and 4, linkage assembly 1180 of control assembly 1100 of the first embodiment of the present invention differs from that of the second embodiment by introduction of gear member 1190 and first and second gear racks, 1192 and 1194, respectively. As may best be seen in FIG. 4, gear rack 1192 is fixed to actuator 1055 at 1195 and will move upward with actuator 1055 through an exercise stroke. Second rack 1194 is attached to carrier portion 1141 of linear Cam 1140 to cause cam 1140 to move longitudinally with rack 1194 as a unit. Gear member 1190 is rotatably mounted with first set of gear teeth 1191 engaged with first gear rack 1192 and second Set of gear teeth 1193 engaged with second gear rack 1194 such that second gear rack 1194 is moved longitudinally in proportion to longitudinal movement of first rack 1192. Control portion 142 of linear cam 1140 is supported directly beneath follower roller 1172 which is mounted directly upon the end of adjustment rod 1110 such that roller 1172 is biased directly against control surface 1146. Thus, the compression length of spring 1094, and the biasing force exerted by spring 1094 on valve element 1091, will be determined in part by the contour of control surface 1126 to control the corresponding exercising force which must be exerted upon exercise member 16 at each point along the exercise stroke.

Figure 7:
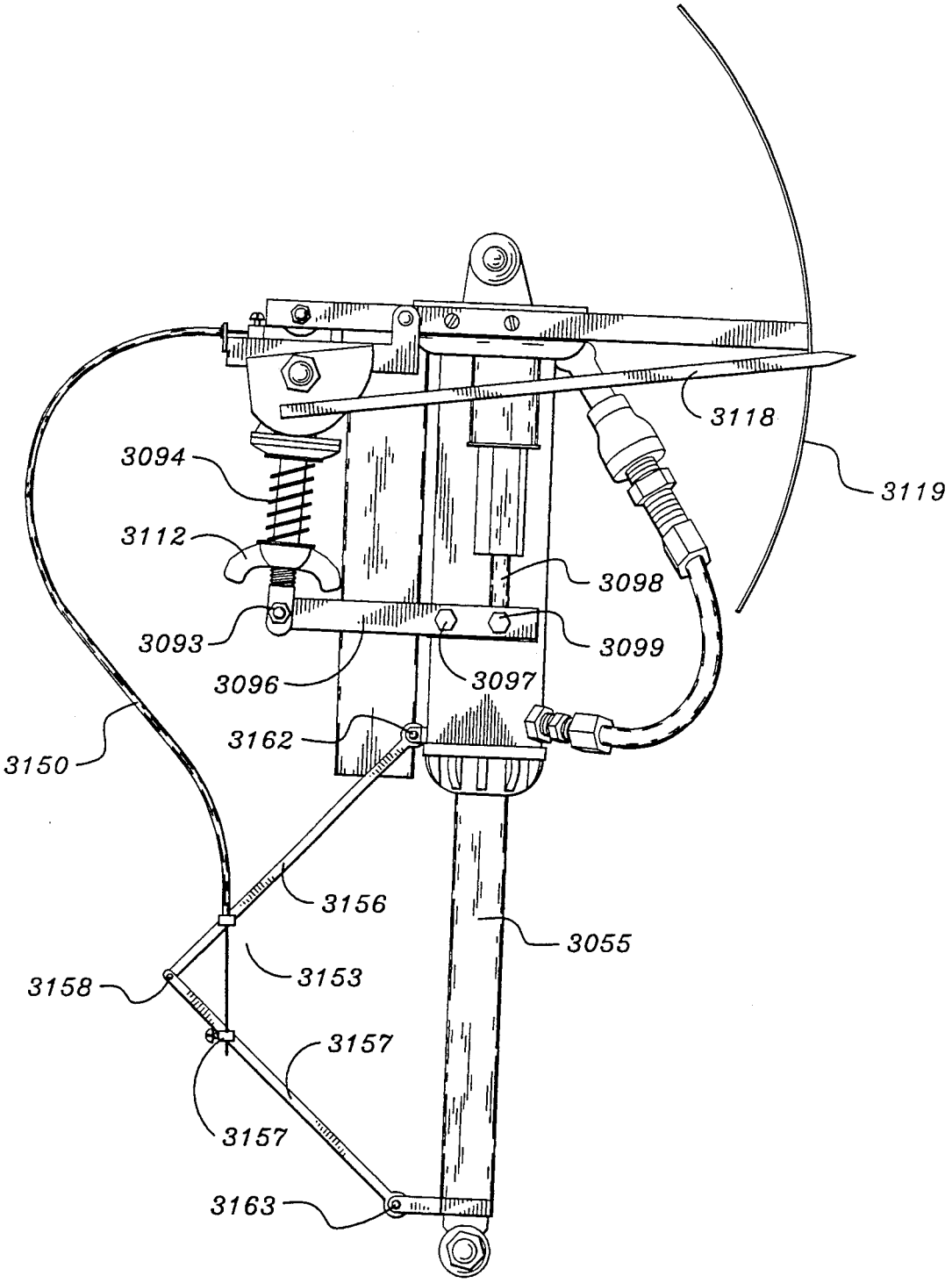
FIG. 7 is a side elevation of the hydraulic resistance member of an exercise apparatus comprising a third embodiment of the present invention.
Figure 8:
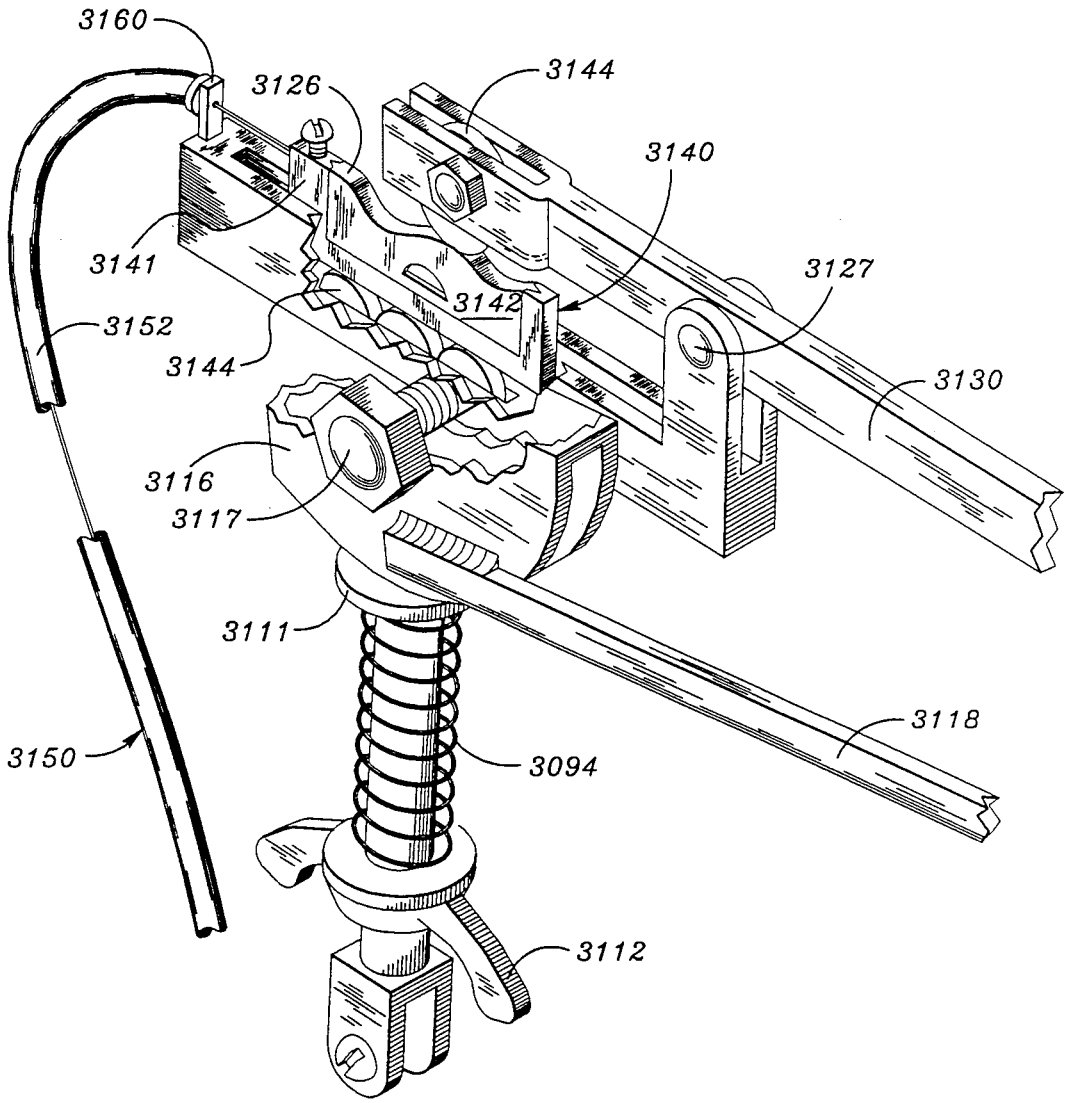
FIG. 8 is an isometric pictorial view of the linear cam assembly of the apparatus of FIG. 7.

A third embodiment comprising the present invention is shown in FIGS. 7 and 8. In that embodiment, valve spring 3094 exerts biasing force on pushrod 3098 by means of rocker arm 3096, which is rotatably supported at fulcrum point 3097 and has a first end pivotally attached to adjustment rod 3110 and a second end pivotally attached to pushrod 3098 at 3093 and 3099, respectively. Carriage portion 3141 is slidably supported in groove 3143 of cam support 3120 by rollers 3144. Control portion 3142 is insertable into carriage portion 3141 and has pointed edges 3125, the apex of which cooperate with interior V-shaped walls of carriage portion 3141 to retain control portion 3142 in carriage portion 3141. Control portion 3142, together with carriage portion 3141, are urged upwardly by the biasing force of valve spring 3094, acting through spring support 3111, adjustment cam 3116, and cam carrier 3120, to bring control surface 3146 of control portion 3142 into contact with roller 3147 which is rotatably fastened to fixed control assembly support beam 130. Cam support 3120 is pivotally connected to control assembly support beam 3130 by cam support pivot pin 3127. Thus, the position of spring support 3111 will be determined, in part, by the local elevation of control surface 3146 of control portion 3142, which is contact with roller 3147. The elevation of control portion 3142 is in turn determined by the longitudinal position of stroke cam 3140 in groove 3143 of cam carrier 3120.

In the embodiment of FIGS. 7 and 8 carriage portion 3141 of cam 3140 is linked to move longitudinally in groove 3143 in proportion to movement of actuator portion 3051 of piston 3054 by control cable 3150. Outer ends of scissor members 3156 and 3157 are pivotally fastened to one another at hinge point 3158. An inner end of scissor member 3156 is pivotally fastened to hydraulic cylinder housing 3056 at 3162 and an inner end of scissor member 158 is pivotally fastened to actuator portion 3055 of piston 3054 at 3163. Control cable 3150 has an interior cable 3151 slidably retained within an outer sheath 3152. Outer sheath 3152 is fastened to scissor member 3156 at point 3153 between its outer and inner end and inner cable 3151 is fastened to scissor member 3157 at point 3154 between its inner and outer end. Thus, when piston 3054 is moved longitudinally within housing 3056 by movement of exercising member 16 during an exercising cycle, inner cable 3151 is caused to slide within outer sheath 3152 of control cable 3150 by a proportional amount, the proportion being determined by the location of points 153, 154 along members 157, 3156, respectively. Sheath 3152 is also attached to control cable bracket 160 on cam support 3120 and inner cable 3152 is attached to carriage portion 3141 of linear cam 3140 by set screw 3161 in such a manner that sliding movement of cable 3151 within sheath 3152 will cause cam 3140 to move longitudinally in groove 3143 of cam support 3120, altering the position of spring support 3111 in accordance with the varying height of control surface 3146 and controlling the linear force exerted on pushrod 3098 and element 3091 of pressure control valve 3090.

Figure 9:
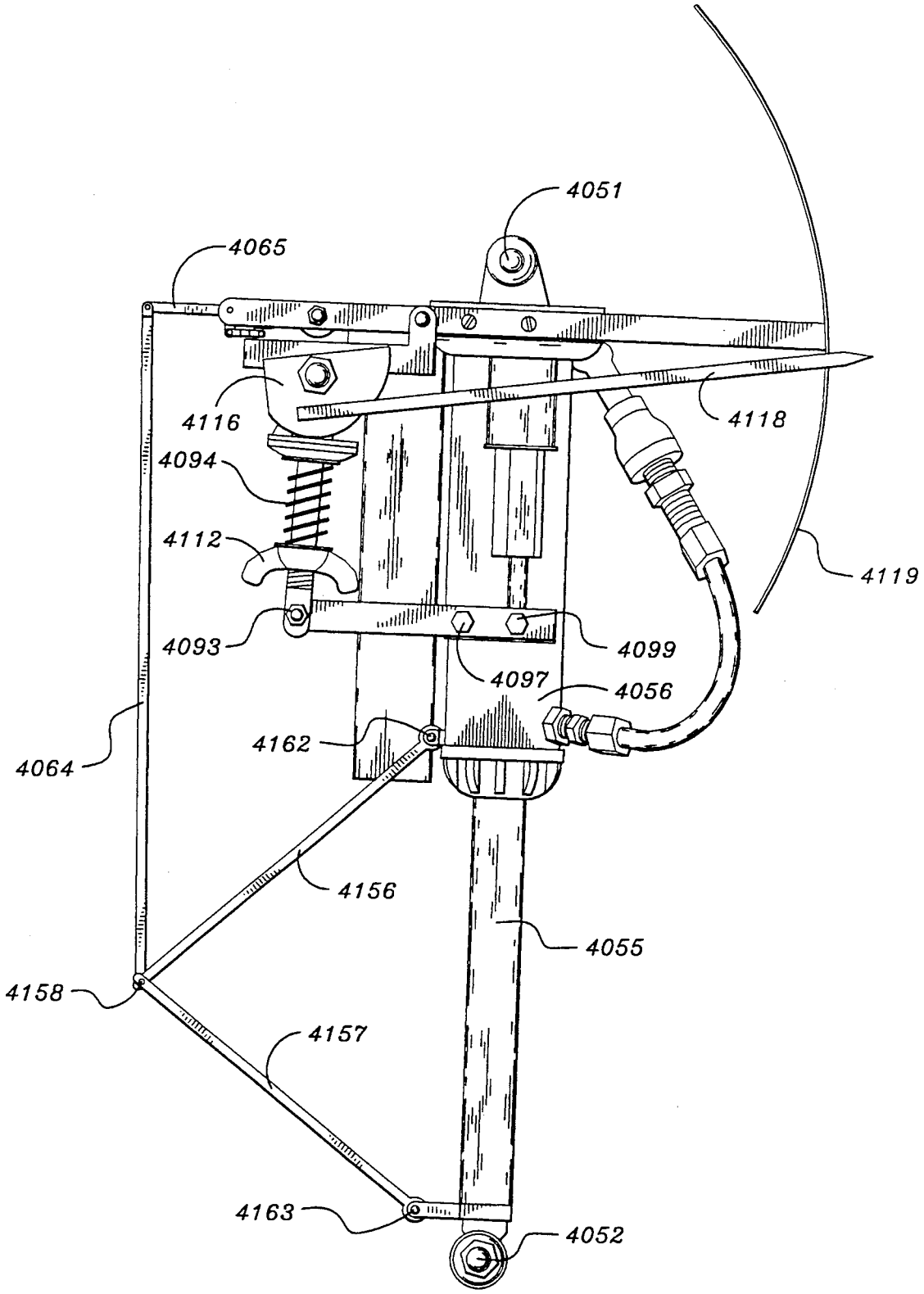
FIG. 9 is a side elevation of the hydraulic resistance member of an exercise apparatus comprising a fourth embodiment of the present invention.
Figure 10:
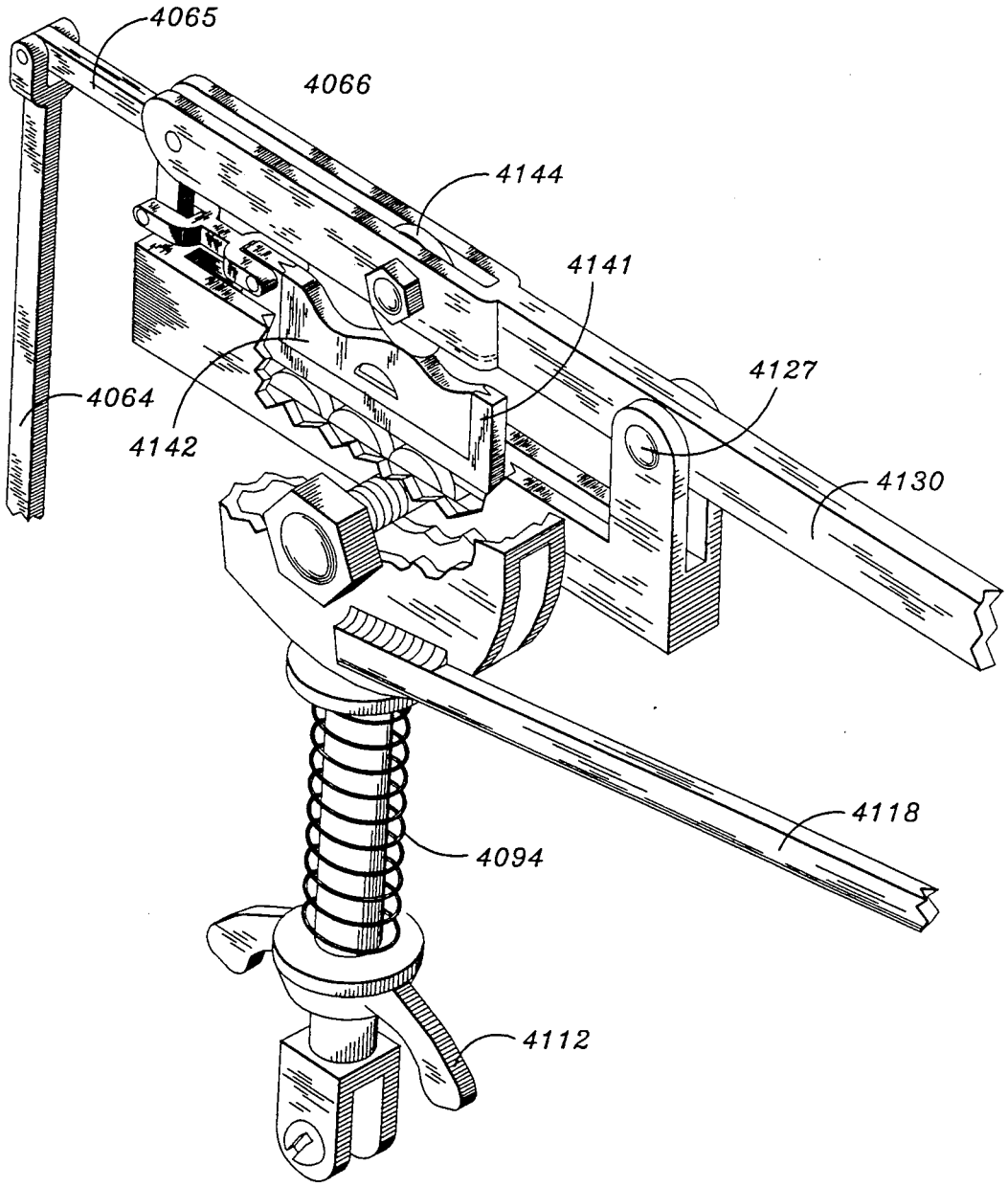
FIG. 10 is an isometric pictorial view of the linear cam assembly of the apparatus of FIG. 9.

A hydraulic resistance assembly 4030 of an exercise apparatus comprising a fourth embodiment of the invention is shown in FIGS. 9 and 10. In the fourth embodiment cam 4140 of hydraulic resistance assembly 4030 is linked to the actuator portion 4055 of hydraulic piston 4054 by scissor members 4157, 4156, pushrod 4064, bell crank 4065 and link member 4066. As in the previous embodiment, scissor members 4156 and 4157 are pivotally attached to housing 4056 at 4162 and to actuator 4055 at 4016, respectively, and pivotally attached to one another at 4158. Thus, up and down motion of actuator 4055 results in a proportional vertical motion of pivotal attachment point 4158 and pushrod 4064. As can best be seen in FIG. 10, vertical motion of pushrod 4064 is converted to horizontal motion of link member 4066 by a bell crank 4065 to move stroke cam 4140 longitudinally in slot 4143 of cam carrier 4120 and control the bias provided by valve spring 4094.

Those familiar with the art will recognize that there are many types of linkage assemblies, well known in the art, which can link the pressure required to cause fluid to flow from chamber 57 to reservoir 61 to the position of actuator 54. These include electronic controls as well as hydraulic and mechanical linkages and the like.

Resistance assembly 30 of hydraulic exercise apparatus 10 comprising the present invention may be made very compact and light because it utilizes a single sided hydraulic cylinder having only a single hydraulic chamber 57 on the side of piston 54 opposite actuator 55 of piston 54. Actuator 55 of piston 54 can thus be made larger in diameter than in the case of a double sided hydraulic cylinder, where the diameter of the actuator must be kept small to minimize the difference in effective area of the two opposite working surfaces of the hydraulic piston of a two sided cylinder, thus resulting in a much stronger hydraulic cylinder. The stronger cylinder may be operated at higher pressures and thus at greater mechanical disadvantage to the exercise member allowing hydraulic cylinder 50 of hydraulic resistance member 30 to be located very close to carrier 20. Thus, lever 31, 32 may be relatively short to provide a compact hydraulic resistance assembly.

In a preferred embodiment of the present invention, hydraulic resistance assembly 30 may be attached to support member 12 at a plurality of locations. Support member 12 is provided with a plurality of pegs 22 and mounting pin holes 23. Carrier 20 is mounted on support member 12 by engaging pegs 22 in carrier mounting slot 24 and then placing mounting pin 25 through aligning pin holes in carrier 20 and support member 12. Those familiar with the art will recognize that a variety of means well known in the art may be used to fix carrier 20 at a chosen point along support member 12, including various latching and clamping mechanisms.

By embracing hydraulic cylinder 50 between lever member 31, 32 on carrier 20, a hydraulic exercise apparatus of great versatility is achieved. Extension 17, with exercise member 16, may be inserted in either of lever members 31, 32 and carrier 20 positioned at different locations on support member 12 to allow a great variety of exercises to be performed. Further, the immobilized lever member may serve as a mounting base for various accessories to provide still further versatility.

Figure 11:
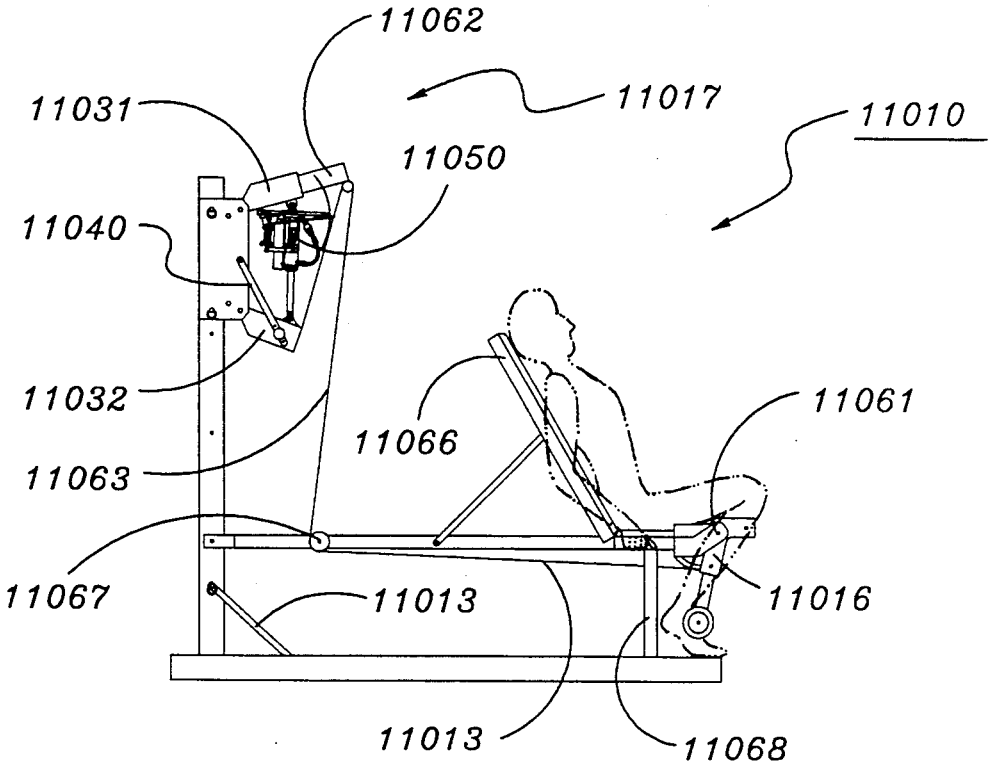
FIG. 11 is a schematic side elevation of an exercise apparatus comprising the present invention in a configuration for leg extension exercise in a sitting position.
Figure 12:
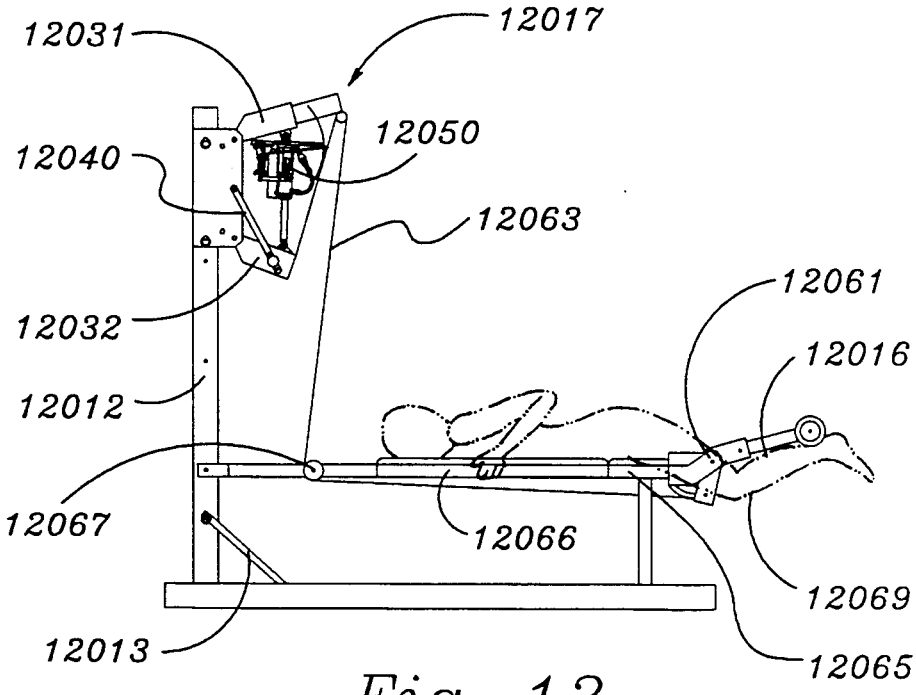
FIG. 12 is a side elevation of an exercise apparatus comprising the present invention in a configuration for leg curl exercises.

Hydraulic exercise apparatus 11010 comprising the present invention is shown in a configuration for leg extension exercise in FIG. 11. Bench 11065 is supported by lower mounting pegs 11022 on support member 11012 and bench legs 11068. Lever member 11032 is immobilized by attachment of immobilizing member 11040 by means of immobilizing pin 11042. Extension member 11017 includes a flexible cable-type portion 11063 and a rigid portion 11062 and is attached to exercise member 11065 at 11061. Flexible portion 11062 extends from leg exercise member 11016 over pulley 11067 and rigid extension member portion 11062 is inserted in lever member 11031. As shown in phantom, when hydraulic exercise 11010 is in use, the user athlete sits on bench 11065 with his back at backrest 11066 and engages exercise member 11016 with his feet to rotate exercise member 11016 about pivot point 11061 at the end of bench 11065 in repetitive exercise cycles. Upward motion of exercise member 11064 requires downward movement of lever 11031 which is resisted by resistance member 11050. Backrest portion 11066 of bench 11065 may be folded down to allow exercise of the legs in a prone, rather than a sitting, position. As seen in FIG. 12, a hydraulic exercise apparatus comprising the invention may be configured with backrest 12066 folded down and extension member 12063 attached to exercise member 12016 at 12069 to provide leg curl exercise.

Figure 13:
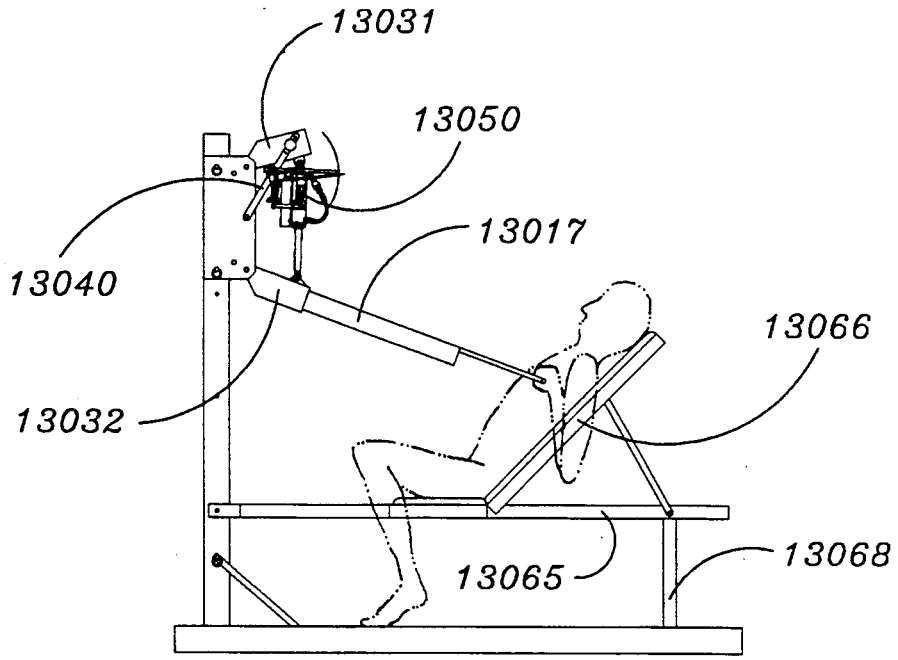
FIG. 13 is a side elevation of an exercise apparatus comprising the present invention in a configuration for inclined bench press exercise.

FIG. 13 shows hydraulic exercise apparatus 13010 in a configuration for inclined bench press exercise. In that configuration, lever member 13031 is immobilized by attachment of immobilizing member 13040. Rigid extension member 13017 is inserted into lever member 13032 and extends to bar-like exercise member 13016. Backrest 13066 is arranged to support the user athlete's back in an inclined manner with the user athlete facing support member 13012. In this position, the user athlete grasps exercise member 13016 with palms toward support member 13012 and works exercise member 13016 in repetitive up-and-down exercise cycles including upward exercise strokes which are resisted by resistance member 13050.

Figure 14:
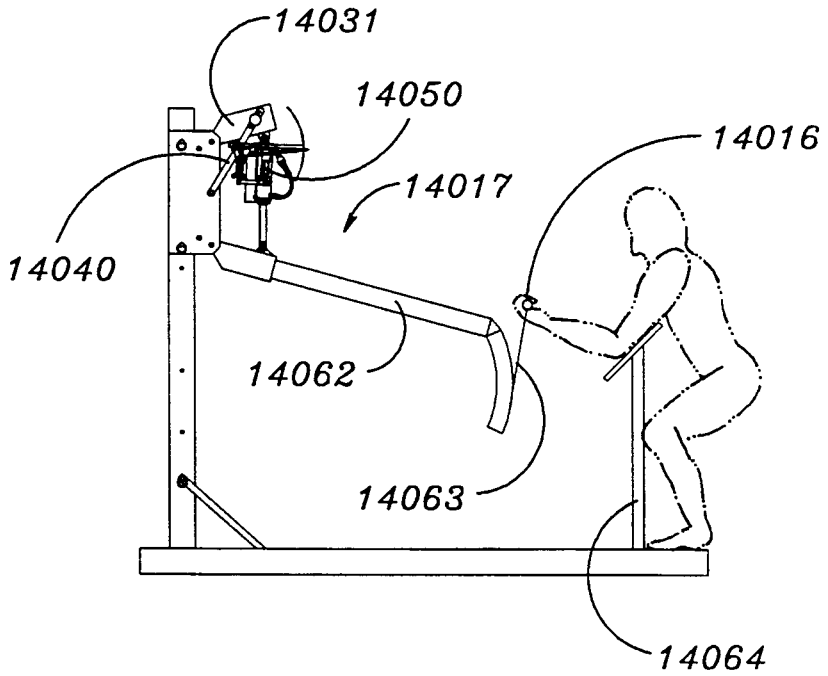
FIG. 14 is a side elevation of a exercise apparatus comprising the present invention in a configuration for bench curl exercise.

FIG. 14 shows hydraulic exercise apparatus 14010 in a configuration for bench curl exercises. Here, lever member 14031 is immobilized by attachment of immobilizing member 14040 Rigid portion 14062 of extension member 14017 is inserted into lever member 14032 and flexible portion 14063 of extension member 14017 ia attached to bar-like exercise member 14016. Upper-arm support stand 14064 is mounted upon base 14014. To utilize exercise apparatus 14010 in this configuration, the user athlete stands on base 14014 facing support member 12 and grasps exercise member 16 with palms facing upward. Exercise member 14016 is then moved in repetitive up-and-down exercise cycles including an upward exercise strokes which are resisted by hydraulic resistance member 50.

Figure 15:
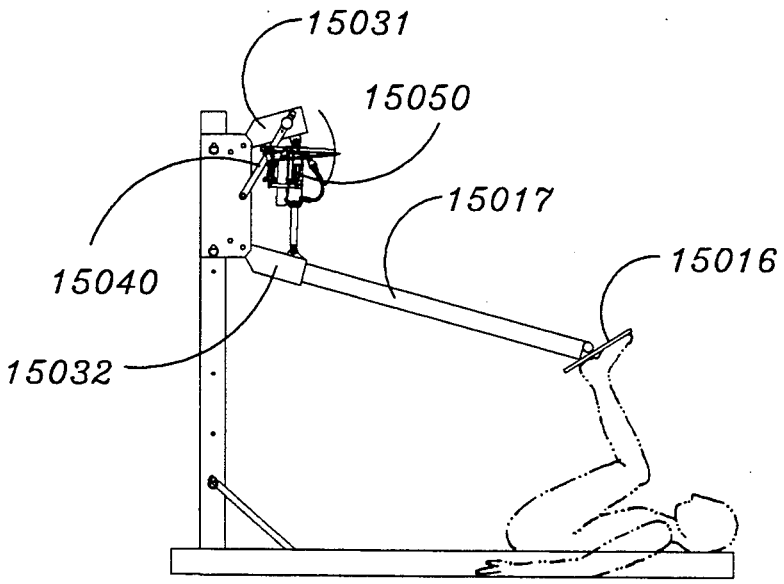
FIG. 15 is a side elevation of an exercise apparatus comprising the present invention in a configuration for leg press exercise.
Figure 16:
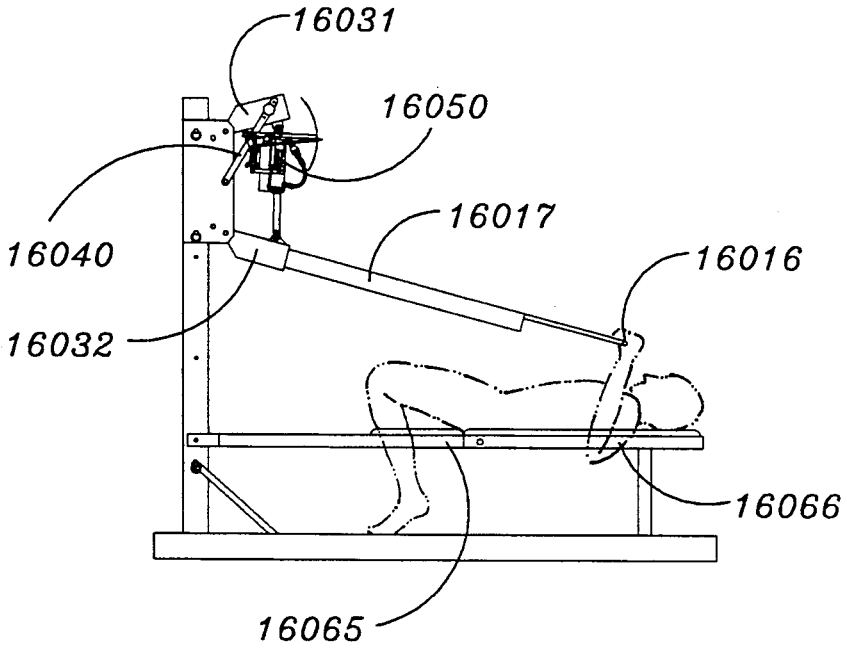
FIG. 16 is a side elevation of an exercise apparatus comprising the present invention in a configuration for bench press, overhead press and behind head triceps exercises.
Figure 17:
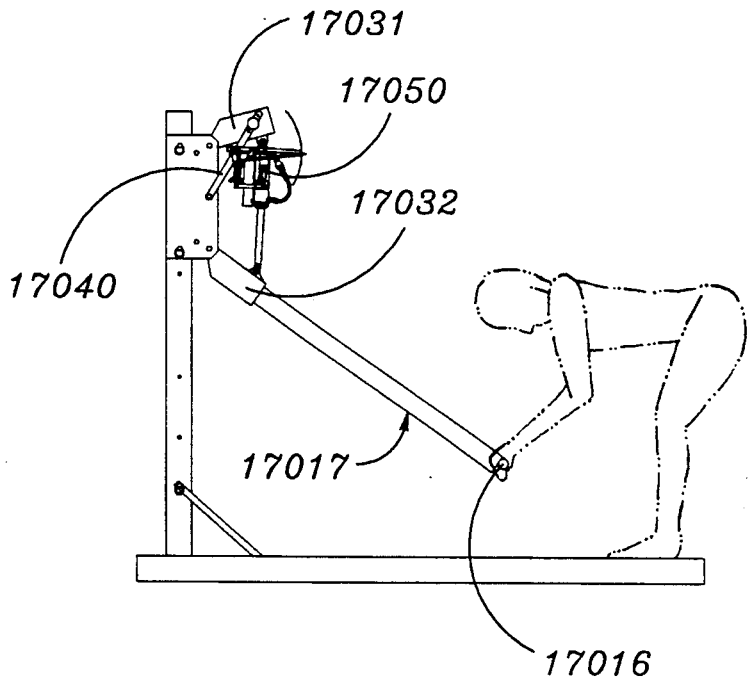
FIG. 17 is a side elevation of an exercise apparatus comprising the present invention in a configuration for standing rowing, upper shrug and curl exercises.
Figure 18:
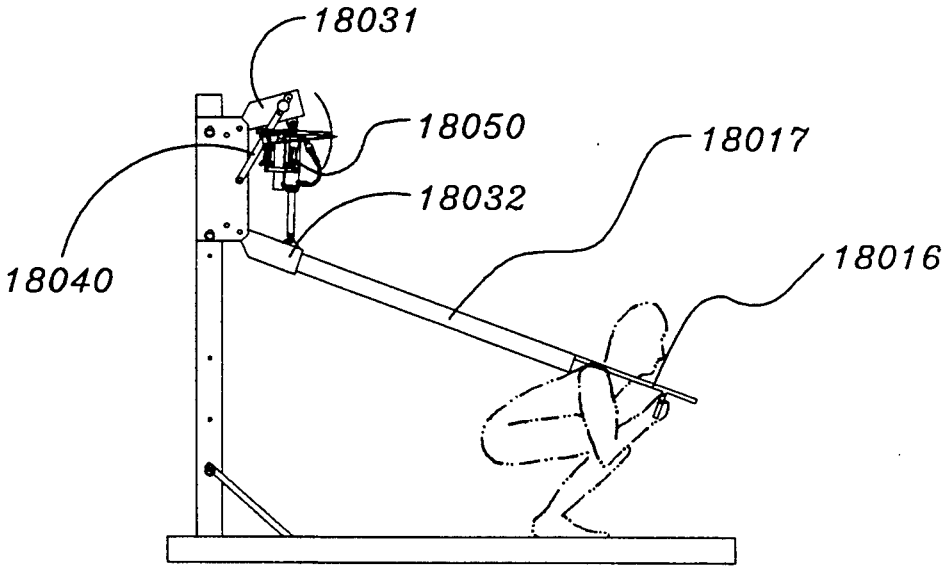
FIG. 18 is a side elevation of an exercise apparatus comprising the present invention in a configuration for squat and toe rise exercises.

FIG. 16 shows hydraulic exercise apparatus 16010 comprising the invention in configuration for bench press, overhead press and behind-the-head triceps exercises. The configuration of hydraulic exercise apparatus 16010 is similar to that of the hydraulic exercise apparatus of FIG. 13 except backrest 16066 is folded flat. FIG. 17 shows hydraulic exercise apparatus 17010 comprising the invention in configuration for standing rowing, shoulder shrug and curl exercises. The configuration of hydraulic exercise apparatus 17010 is similar to that of hydraulic exercise apparatus 13010 and hydraulic exercise apparatus 17010 except that no bench is utilized. In FIG. 15, hydraulic exercise apparatus 15010 is configured for leg press exercises with exercise member 15016 adapted to be pressed in a upward exercise stroke by a user athlete while reclined on his back beneath exercise member 15016. Hydraulic exercise apparatus 18010 of FIG. 18 is configured with exercise member 18016 adapted to be engaged by a squatting user athletes shoulders and be raised through an exercise stroke during repetitive up-and-down cycles.

Figure 19:
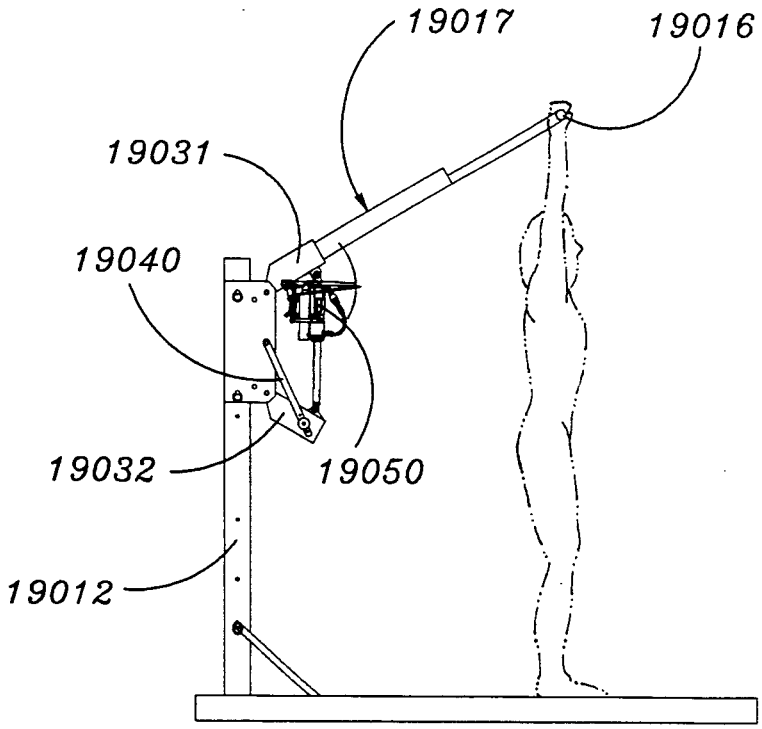
FIG. 19 is a side elevation of an exercise apparatus comprising the present invention in a configuration for lats, chin-up and pull down exercises.
Figure 20:
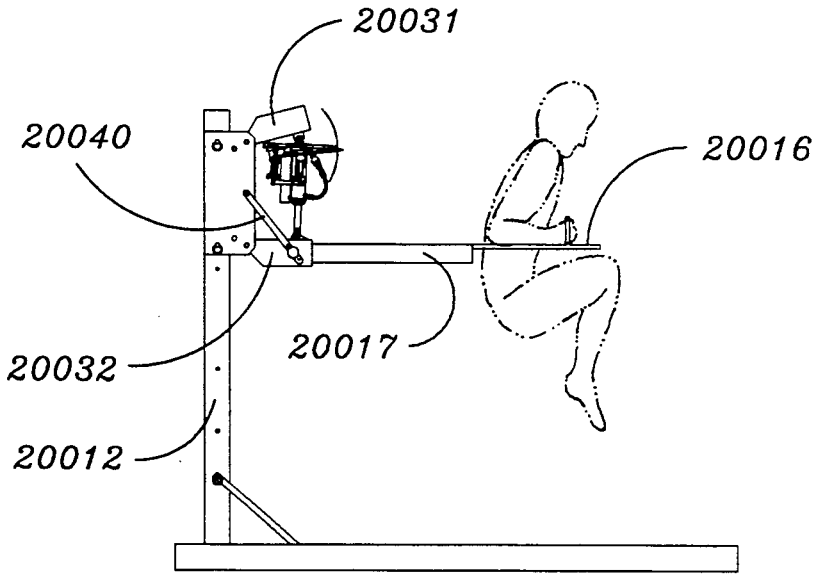
FIG. 20 is a side elevation of an exercise apparatus comprising the present invention in a configuration for knee lift and dip exercises.

Hydraulic exercise apparatus 19010 of FIG. 19 is shown in configuration for lateral pull down exercises. Lever member 19032 of hydraulic exercise apparatus 19010 is immobilized by engagement with immobilizing member 19040 and extension member 19017 is inserted in lever member 19031. In this configuration, the user athlete pulls member 19016 downward through exercise strokes of repetitive up-and-down exercise cycles. In otherwise the same configuration, lever member 19031 may be immobilized and exercise member 19016 utilized for chin-up exercise. FIG. 20 shows extension member 20017 inserted into immobilized lever member 20032 to allow hydraulic exercise apparatus 20010 to be utilized for knee-lift and dip exercises.

Figure 21:
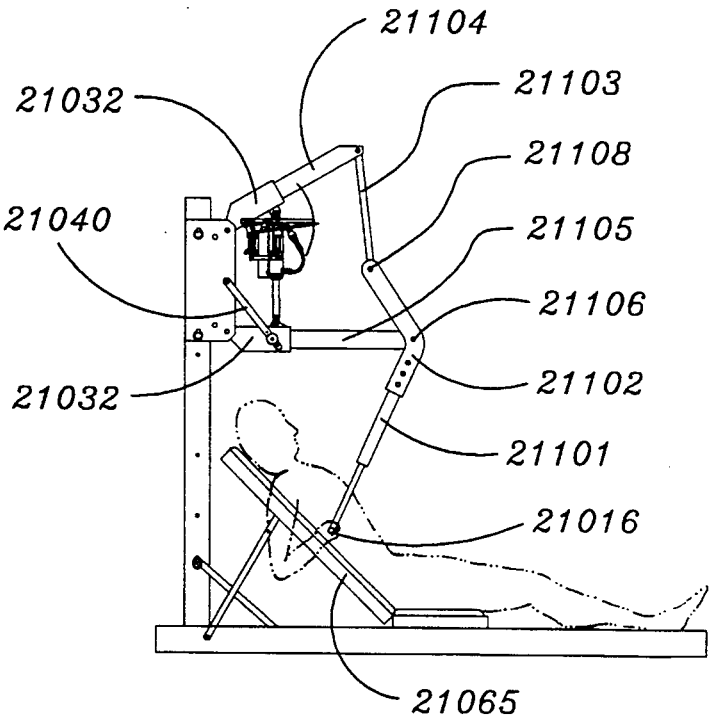
FIG. 21 is a side elevation of an exercise apparatus comprising the present invention in a configuration for reclined lateral press exercise.

Hydraulic exercise apparatus 21010 is shown in a configuration for reclined lateral press exercises in FIG. 21. In FIG. 21, lever member 21032 is immobilized by attachment of immobilizing member 21040. Mounting member 21105 is inserted in lever members 21032. Inclined bench press extension member 21017 includes first, second, third and fourth portions 21101, 21102, 21103 and 21104, respectively. Extension member portion 21102 is pivotally attached to mounting member 21105 at 21106. Extension member portion 21103 is pivotally linked to portions 21104 and 21106 at 21107 and 21108, respectively. Back rest 21066 rests against support member 21012 and is supported by base 21014 of hydraulic exercise apparatus 21010. In this configuration the user athlete sits with his back against backrest 21066 facing away from support member 21012 and grasp exercise member 21016 with his palms facing away from support member 21012. In this position, the user athlete pushes exercise member 21016 away from support member 21012 in an exercise stroke which is resisted by compression of hydraulic resistance member 21050.

Figure 22:
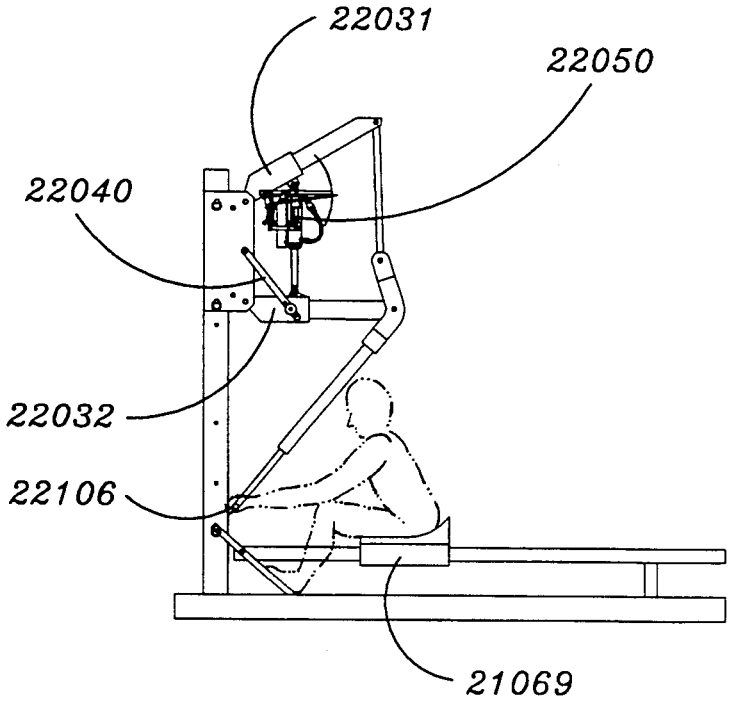
FIG. 22 is a side elevation of an exercise apparatus comprising the present invention in a configuration for rowing exercise.

In a similar configuration, except for the substitution of rowing bench 22069, hydraulic resistance exercise apparatus 22010 may be utilized for rowing exercises as illustrated in FIG. 22. In this configuration, exercise member 22016 is drawn away from support member 22012 in an exercise stroke which is resisted by compression of resistance member 22050.

Figure 23:
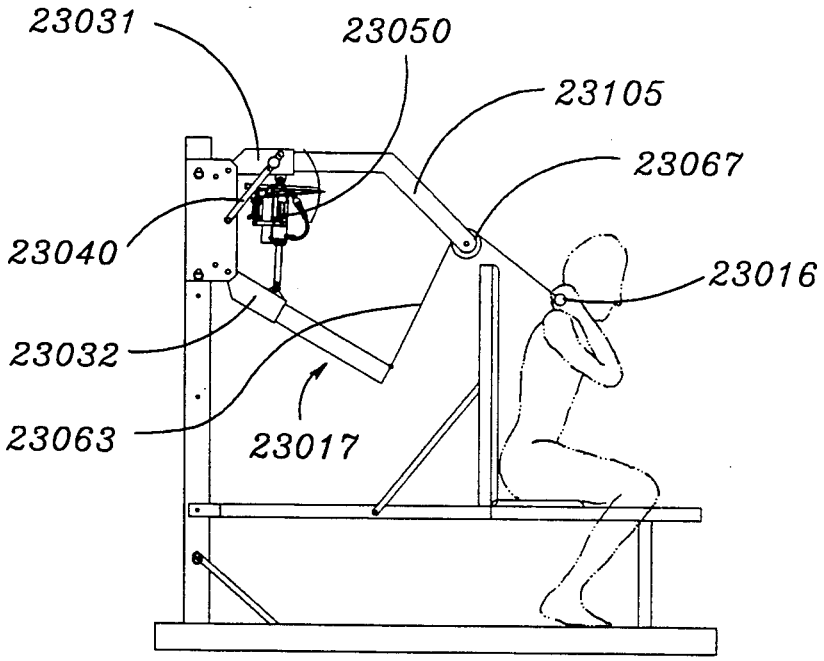
FIG. 23 is a side elevation of an exercise apparatus comprising the present invention in a configuration for abdominal exercise.
Figure 24:
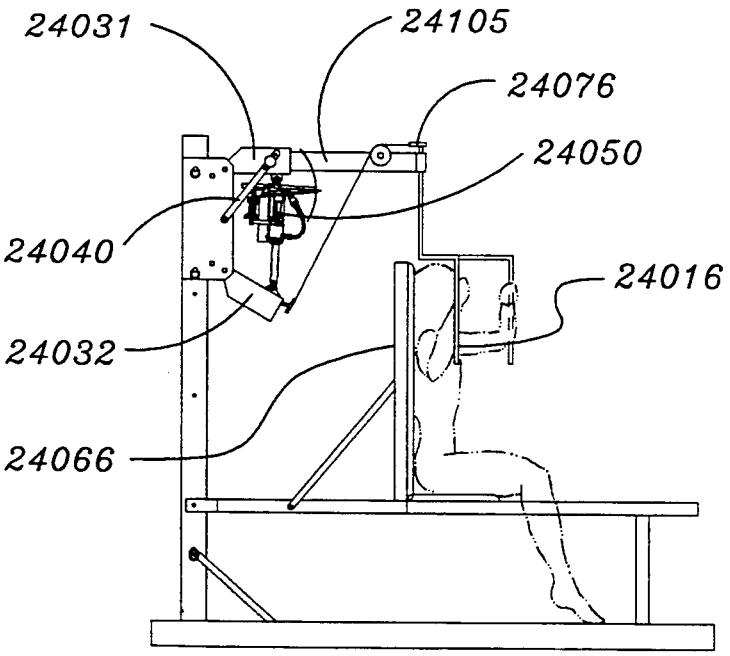
FIG. 24 is a side elevation of an exercise apparatus comprising the present invention in a configuration for pectoral and upper back exercise.

Many other configurations may be utilized with hydraulic exercise apparatus embodying the present invention to facilitate complete and exhaustive exercise conditioning programs. Further examples of configurations of such hydraulic resistance exercise apparatus are shown in FIGS. 23 and 24. In FIG. 23, hydraulic exercise apparatus 23010, configured suitably for back exercise, is illustrated. In this configuration, a user athlete sits on bench 23065 and bends forward, drawing rope-like exercise member 23016 away from support member 23012 in an exercise stroke resisted by hydraulic resistance member 23050. FIG. 24 shows hydraulic exercise apparatus 24010 comprising the present invention in a configuration for fly, reverse fly, pectoral and upper back exercises. In this configuration, the user athlete sits on the exercise bench 24065 and draws fly exercise members 24016 toward one another to rotate wench drums 24076 and wrap flexible extension member portion 24063 about drums 24076 and drawing pulley 24078, attached to lever member 24032, upward against the resistance of resistance member 24050.

Figure 25:
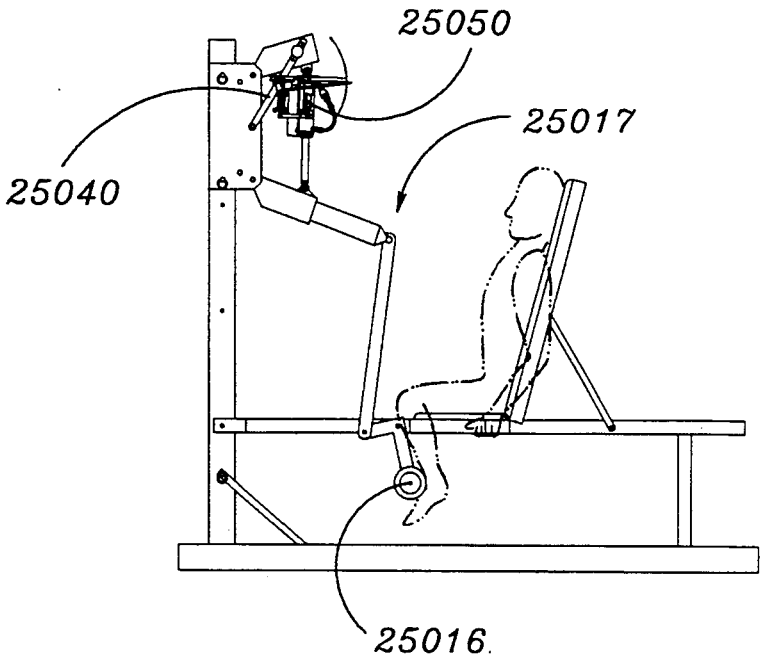
FIG. 25 is a side elevation of an exercise apparatus comprising the present invention in an alternative configuration for sitting leg extension exercise.
Figure 26:
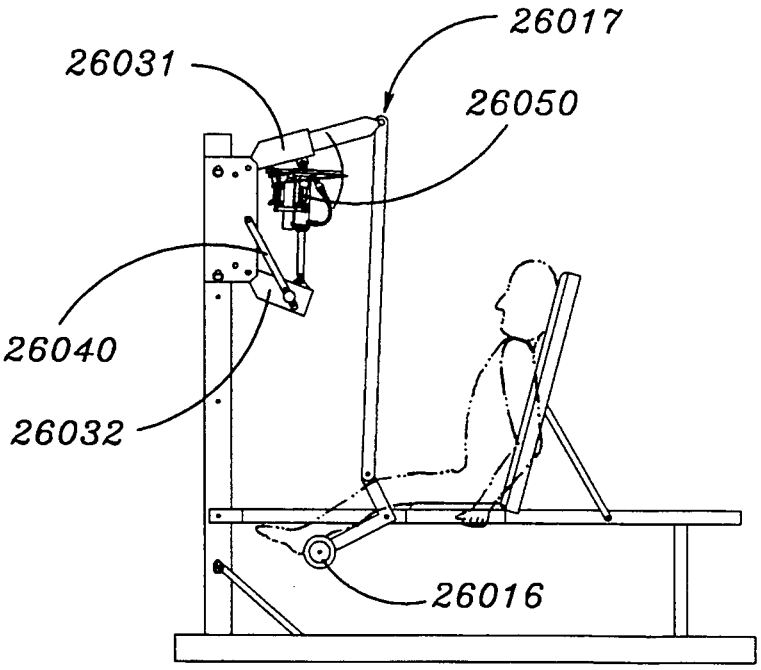
FIG. 26 is a side elevation of an exercise apparatus comprising the present invention in an alternative configuration for sitting leg curl exercise.

FIGS. 11 through 24, discussed above, illustrate 14 exemplary configurations in which hydraulic exercise apparatus comprising the present invention may be utilized to perform a comprehensive exercise program including at least 19 muscle development exercises. Alternative configurations for leg extension and sitting leg curl exercises are shown in FIGS. 25 and 26, respectively. Those familiar with the art will realize that many additional configurations of hydraulic exercise apparatus comprising the present invention are possible which will allow such hydraulic resistance apparatus to provide yet more extensive and varied programs of muscular conditioning exercises.

Figure 27A:
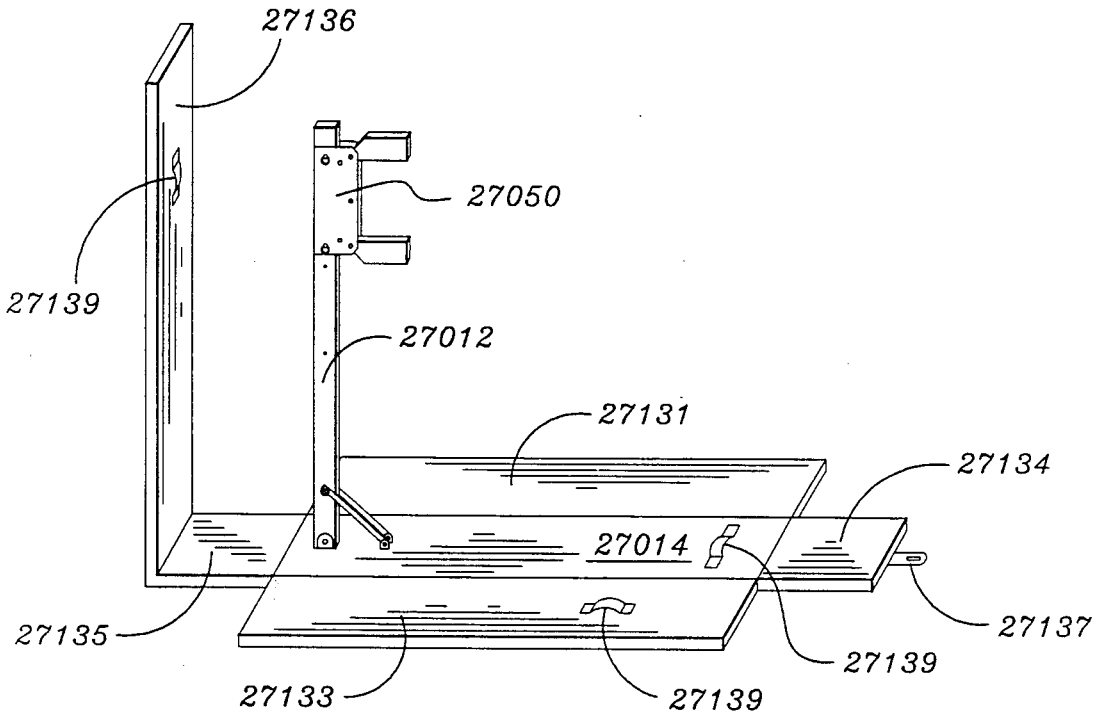
FIG. 27*a* is a pictorial view of an exercise apparatus with an integral storage/transportation container in open configuration for use comprising the present invention.
Figure 27B:
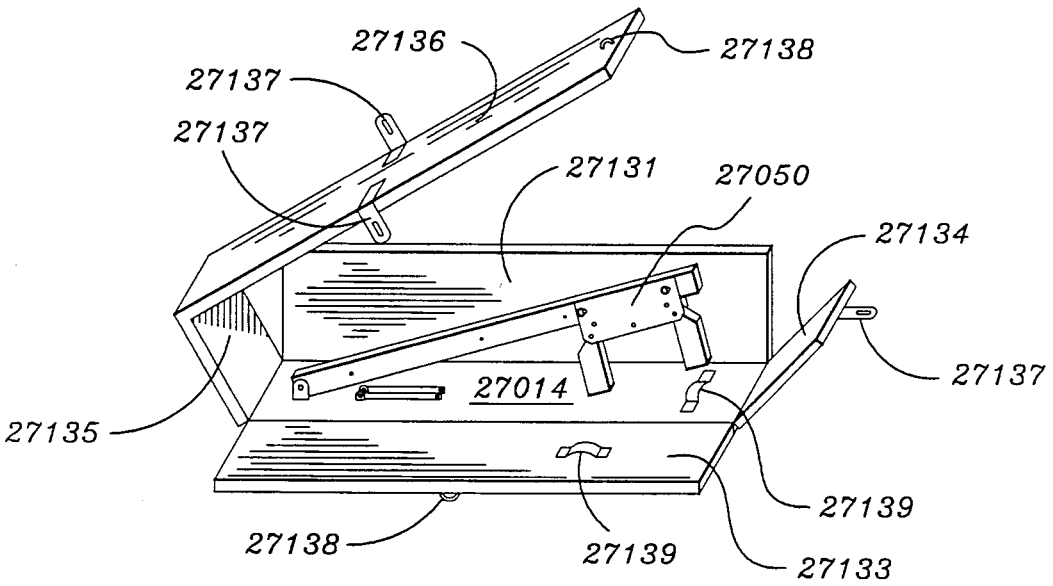
FIG. 27*b* is a pictorial view of an exercise apparatus with an integral storage/transportation container in a partially closed configuration for transportation or storage comprising the present invention.
Figure 28A:
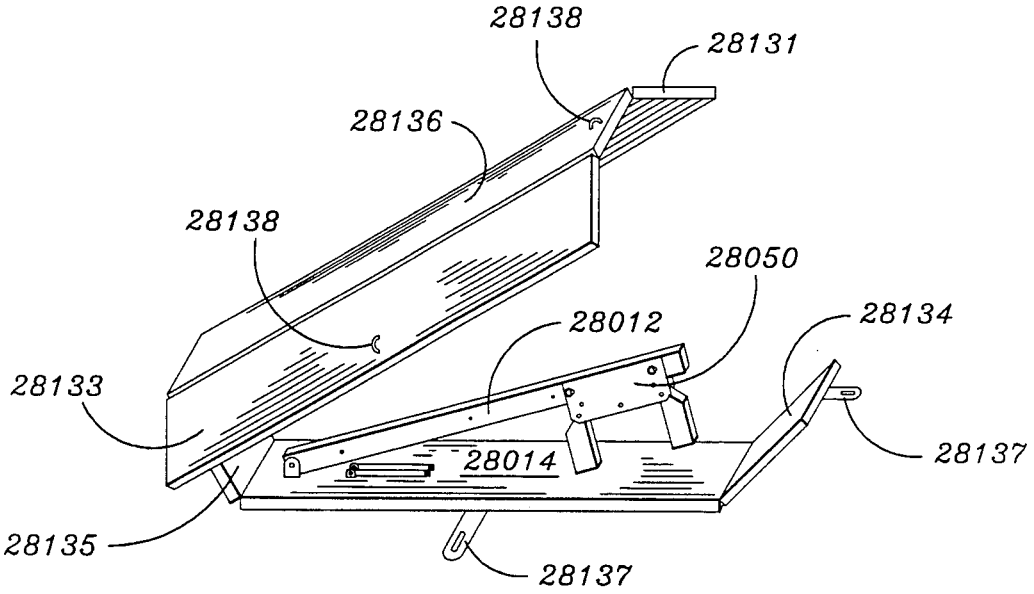
FIG. 28*a* is a pictorial view of an alternative embodiment of an exercise apparatus comprising the present invention with an integral storage/transportation container in a partially open configuration.
Figure 28B:
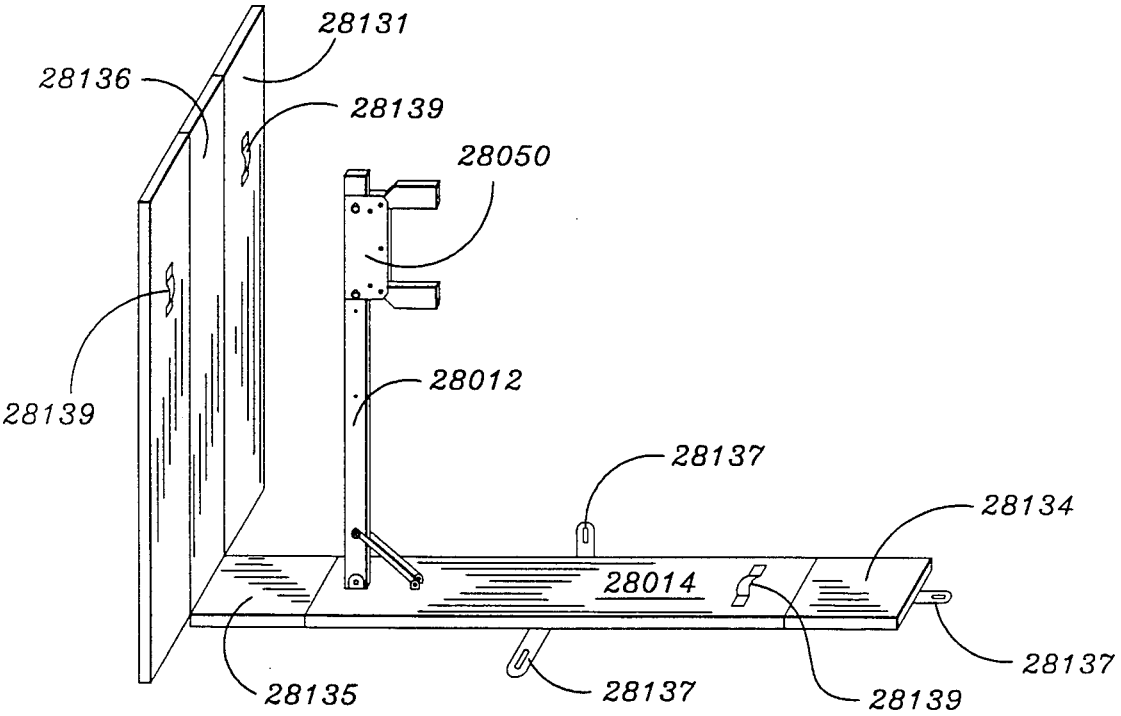
FIG. 28*b* is a pictorial view of an alternative embodiment of an exercise apparatus comprising the present invention with an integral storage/transportation container in an open configuration for use.
Figure 30:
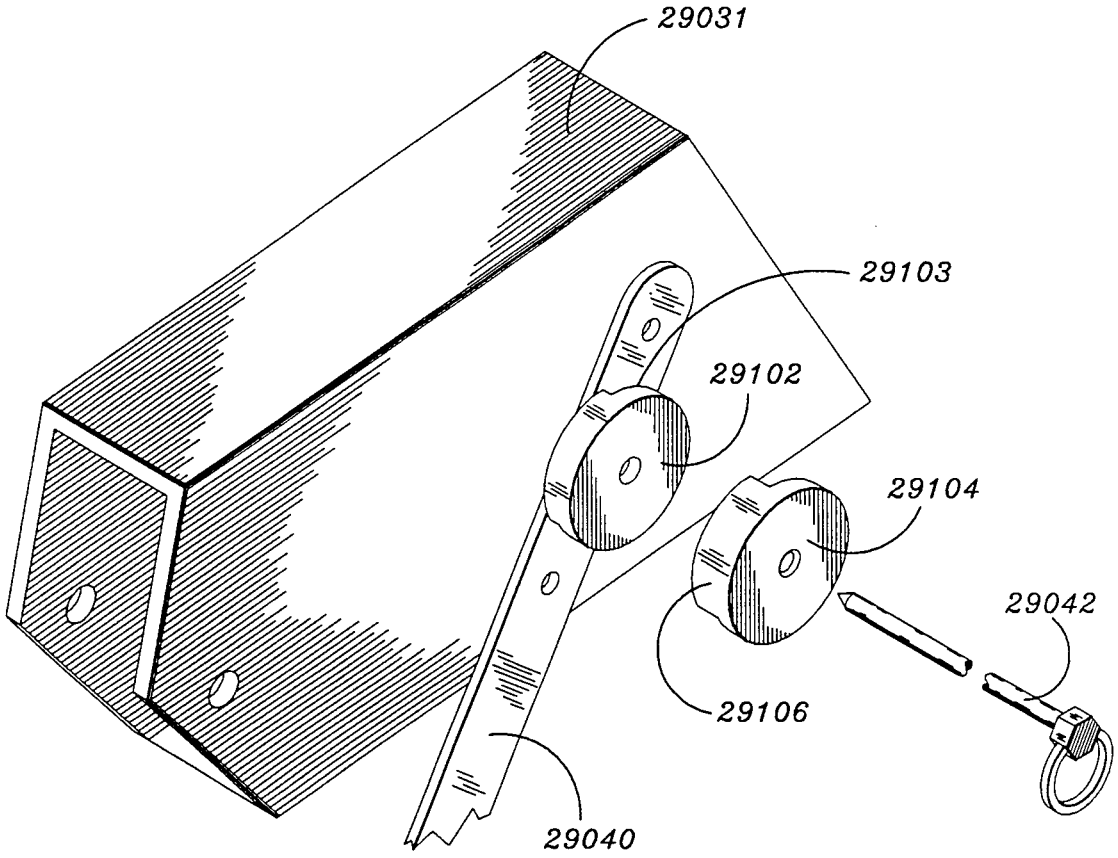
FIG. 30 is an isometric pictorial view, inclose up, of a centering device of the embodiment of FIG. 29.

An embodiment of the hydraulic exercise apparatus of the present invention including an integral transportation and storage container 27132 is shown in an open configuration in FIG. 27*a* and a partially closed configuration in FIG. 27*b*. Storage container 27132 comprises a base 27014, first and second side panels 27131 and 27133, first end panel 27134, second end panel 27135 and top panel 27136. In the embodiment of FIG. 27, top panel 27136 and second end panel 27135 are rigidly joined, and first end panel 27134, second end panel 27135, first side panel 27131 and second side panel 27133 are each hingedly joined to respective edges of base 27014. From the open position of FIG. 27*a*, strut pin 27026 may be removed from cooperating holes 27028 in support strut 27013 and support member 27012, or strut pin 27027 removed from cooperating holes 27029 in support strut 13 and base bracket 27021, to allow support member 27012 to be rotated about pivot point 27015 until resistance assembly 27050 is brought into contact with base 27014. Wing nut 27112 and cam 27116 may be set for zero threshold force to allow positioning of lever members 27031 and 27032 as desired. Strap 27138 may then be utilized to fix resistance assembly 27050 adjacent base 27014, and panels 27131, 27133, 27135 and 27136 folded together to enclose exercise apparatus 10 in the storage and transport container 27132. Panels 27131, 27133, 27135 and 27136 may be fixed in the closed configuration by closing hasps 27137 about cooperating "U" bolts 27138 and locking them in place with lock pins or pad locks. Those familiar with the art will recognize that various hooks, straps or latch means which are well known in the art may also be utilized to retain the panels in the closed configuration and to retain resistance assembly 27050 adjacent to base 27014. Top panel 27136 may be provided with holders on its interior surface to display various accessories for ready access while hydraulic apparatus 27010 is in use. Panels 27131, 27133, 27135 and 27136 may also be provided with retention means to facilitate storage of accessories within transport and storage container 27132 when the exercise apparatus is folded for storage or transport. In an alternative embodiment, shown in FIG. 30, side panels 131, 133 are hingedly joined to respective edges of top panel 136 to provide a larger area for attaching accessories when the hydraulic exercise apparatus in an open configuration for exercise use.

While an exemplary hydraulic resistance exercise apparatus comprising a preferred embodiment of the present invention has been shown, it will be understood, of course, that the invention is not limited to that embodiment. Modification may be made by those skilled in the art, particularly in light of the foregoing teachings. For example, while a mechanical means for controlling exercising force during the exercise stroke of the hydraulic exercise apparatus has been shown, an electronic force control system including a pressure sensor to sense the pressure in chamber 57 and an electronic control device to operate pressure control valve 90 control pressure during the exercise stroke in response to the output of the pressure sensor, in accordance with a program suitable for the particular exercise, exercise apparatus configuration, and condition of the user athlete may be utilized. It is, therefore, contemplated by the appended claims to cover any such modification which incorporates the essential features of this invention where encompasses the true spirit and scope of the invention.

I claim

1. A hydraulic exercise apparatus comprising:

hydraulic pump means including an actuator for pumping fluid through a fluid circuit in response to a pumping movement of said actuator in such a manner that a force required to cause said pumping movement of said actuator is dependent upon a pressure of the fluid pumped;

a fluid circuit in fluid communication with said pump including first fluid valve means for allowing fluid to flow through a first flow passage of said circuit only when a fluid pressure at an upstream side of said valve means exceeds a selected pressure;

an exercise member upon which a user of the exercise apparatus may exert an exercising force to cause said member to move along an exercise stroke;

linking means for linking said exercise member to said actuator in such a manner that said exercise member may move along said exercise stroke only by causing pumping movement of said actuator such that said exercise member may move along said exercise stroke only when said exercising force exceeds a threshold force corresponding to said selected pressure; and pressure selection means for determining said selected pressure in accordance with the position of said exercise member along said exercise stroke.

2. An exercise apparatus as in claim 1, in which said exercise member is movable through an exercise cycle from an initial position along said exercise stroke and thence along a return stroke to return to said initial position and, said fluid circuit further includes second fluid valve means for allowing fluid to flow freely through a second flow passage of said circuit only during said return stroke whereby no exercising force is required to move said exercise member through said return stroke.

3. An exercise apparatus as in claim 2, in which said pump means is a single side hydraulic cylinder.

4. A hydraulic exercise apparatus comprising:

a hydraulic cylinder including a housing and a piston within said housing, said piston and housing together defining a hydraulic chamber and a fluid port through which fluid may flow into and out of said chamber, the piston slidable within the housing such that a volume of the hydraulic chamber may be decreased and increased by movement of the piston to expel hydraulic fluid from the chamber or draw hydraulic fluid into the chamber, respectively, through said port;

a fluid circuit in fluid communication with said fluid port for allowing fluid to flow from said chamber only when a fluid pressure in said chamber exceeds a selected pressure and allowing fluid to flow freely into said chamber when the volume of said chamber is increased;

an exercise member for engagement by a user of the exercise apparatus;

linking means for mechanically linking said exercise member to said piston so that movement of said exercise member in an exercising direction causes the volume of said chamber to decrease and movement of said exercising member in a return direction causes the volume of said chamber to increase, whereby the user may move said exercise member in said exercising direction only by exerting an exercising force on said exercise member greater than a selected force corresponding to said selected pressure and the user may move the exercise member in said return direction without exerting an exercising force; and pressure selection means for selecting said selected pressure in accordance with a position of said exercise member.

5. A hydraulic exercise apparatus as in claim 4, in which said fluid circuit includes:

a reservoir for containing a variable amount of hydraulic fluid;

a flow passage communicating said reservoir with said fluid port; and control means for controlling fluid flow through said passage, said control means allowing fluid to flow from said chamber to said reservoir only when the pressure in said chamber is above said selected pressure and allowing fluid to flow from said reservoir to said chamber only when the pressure in said chamber is below a reference pressure.

6. A hydraulic exercise apparatus as in claim 4, in which said fluid circuit includes:

a hydraulic reservoir for containing a variable quantity of hydraulic fluid at a generally constant pressure;

first and second fluid flow passages, each of said first and second fluid flow passages communicating between said chamber and said reservoir;

first fluid valve means for controlling fluid flow through said first passage, said first valve means allowing fluid to flow from said chamber to the reservoir only when the fluid pressure in said chamber is above said constant pressure by a selected pressure differential corresponding to said selected pressure; and, second fluid valve means for controlling fluid flow through said second passage, said second valve means allowing fluid to flow freely from said reservoir to said chamber but preventing fluid from flowing through said second passage from said chamber to said reservoir.

7. A hydraulic exercise apparatus as in claim 6, in which:

said second valve means is a check valve, and said first valve means comprises a seat and a valve element in said first fluid flow path, said valve element located in a downstream direction from said seat, said first valve means further comprising biasing means for urging said valve element in an upstream direction against said seat with a biasing force corresponding to said selected pressure differential thereby closing off said first path except when a pressure upstream of said valve, greater than a pressure downstream of said valve by said selected pressure differential, acts upon said valve thereby lifting it from said seat to allow fluid to flow in the downstream direction.

8. A hydraulic exercise apparatus as in claim 7, in which said biasing means is a compressed spring, said spring located externaly of both said first flow passage and said second flow passage.

9. A hydraulic exercise apparatus as in claim 7, in which said valve element is spherical.

10. A hydraulic exercise apparatus as in claim 7, in which said biasing means is a compressed spring having a first end and a second end lying on a spring axis and separated by a compression length, said first end supported by a first spring support, and said pressure selection means comprises bias control means including said first spring support is movable along said spring axis to select said compression length thereby determining said biasing force.

11. A hydraulic exercise apparatus as in claim 10, in which said pressure selection means comprises bias control means for positioning said first spring support along said spring axis in accordance with a position of said exercise member.

12. A hydraulic exercise apparatus as in claim 11 in which said bias control means includes rotary cam means.

13. A hydraulic exercise apparatus as in claim 11, in which said bias control means includes linear cam means.

14. A hydraulic exercise apparatus as in claim 13, in which said linear cam means includes a linear cam having a first and second cam surface lying on opposite sides of a longitudinal cam axis and defining a cam width therebetween, said cam width varying along said longitudinal axis, cam support means for slidably supporting said first surface and allowing movement of said cam in a longitudinal direction, cam follower means for slidably contacting said second surface such that said linear cam is interposed between said cam support and said cam follower and a separation distance between said follower means and said support means is determined by the longitudinal position of said linear cam, and said bias control means further comprises first spring support linking means for positioning said first spring support in accordance with said separation distance such that said compression length is determined in accordance with the longitudinal position of said cam and cam linking means for linking the longitudinal position of said cam to the position of said exercise member.

15. A hydraulic exercise apparatus as in claim 14 in which said piston and said chamber have a common longitudinal axis, said piston is slidable along said piston-chamber axis, said longitudinal cam axis is parallel to said longitudinal piston-chamber axis, and said cam and said piston are in fixed geometric relation, whereby movement of said piston along said piston-chamber axis causes an equal movement of said cam along said longitudinal cam axis.

16. A hydraulic exercise apparatus as in claim 14 in which said piston and said chamber have a common longitudinal axis, said piston is slidable along said piston-chamber axis, said longitudinal cam axis is transverse to said piston-chamber axis, and said cam linking means comprises first rack means having a longitudinal axis, said first rack means longitudinal axis lying parallel to said piston-chamber axis, said first rack means in fixed in geometric relation to said piston such that movement of said piston along said piston-chamber axis results in an equal movement of said first rack means along said first rack means longitudinal axis, second rack means having a longitudinal axis lying parallel with said cam axis said second rack means fixed in geometric relation to said linear cam such that movement of said second rack means along said second rack means longitudinal axis results in an equal movement of said linear cam along said longitudinal cam axis, and gear means, said gear means engaged with each of said first and second rack means such that said second rack means is constrained to move along said second rack means longitudinal axis an amount a direct proportion of movement of said first rack means along said first rack means longitudinal axis.

17. A hydraulic exercise apparatus as in claim 16 in which said proportion is one to one.

18. A hydraulic exercise apparatus as in claim 16 in which said proportion is less than one to one.

19. A hydraulic exercise apparatus as in claim 16 in which said proportion is greater than one to one.

20. A hydraulic exercise apparatus as in claim 13, in which said linear cam has a base portion including a portion of said first surface and an insert portion including a portion of said second surface and said insert portion is releasably attached to said base portion.

21. A hydraulic exercise apparatus as in claim 20, in which said first surface is a planar surface.

22. A hydraulic exercise apparatus as in claim 10, further comprising a second spring support, said second spring support supporting said second end and selectively positionable along said spring axis to determine a base compression length and a corresponding base biasing force.

23. A hydraulic exercise apparatus comprising:

a support member having a longitudinal support member axis;

a carrier adapted to engage said support member and longitudinally movable along said support member, said carrier having a longitudinal carrier axis parallel to said support member axis;

releasable locking means for fixing said carrier at a selected longitudinal position along said support member axis;

first and second lever members pivotally attached to said carrier at a first and second hinge point, respectively, said first and second hinge points separated by a distance along said carrier axis, said first and second lever members extending outwardly away from said carrier to a first and second free distal end, respectively, and having a first and second longitudinal lever member axis, respectively, such that said first and second lever member axes are pivotable in a common plane parallel to said carrier axis;

a hydraulic resistance member having a first end portion and a second end portion defining a longitudinal resistance member axis, said first and second end portions movable toward one another along said axis when so urged by a force greater than a first pre-selected force and movable away from one another along said axis when so urged by a force greater than a second preselected force, said first end portion pivotally attached to said first lever member at a point lying between said first hinge point and said first free distal end, and said second end portion pivotally attached to said second lever member at a point lying between said second hinge point and said second free distal end; and immobilizing means for immobilizing one of said first and second lever members in a fixed position relative to said carrier.

24. A hydraulic exercise apparatus as in claim 23, in which said immobilizing means comprises:

an immobilizing arm having a hinge end portion and a pin end portion together defining a longitudinal immobilizing member axis;

hinge means for hingidly attaching said hinge end portion to said carrier at an immobilizing member hinge point; and attachment means for selectively attaching said pin end portion to one of said first and second lever members thereby immobilizing the selected lever member.

25. A hydraulic exercise apparatus as in claim 24, in which said immobilizing member hinge point is equally distant from said first and second hinge points.

26. A hydraulic exercise apparatus as in claim 24, in which said attachment means comprises:

a cylindrical elongate immobilizing pin;

each of said free distal ends defines a lever arm pin hole adapted to receive said immobilizing pin; and, said pin end of said immobilizing arm defines an immobilizing member pin hole such that said immobilizing pin may be passed through said immobilizing member pin hole and one of said lever member pin holes to attach said immobilizing arm to one of said lever members.

27. A hydraulic exercise apparatus as in claim 24, further comprising:

an extension member with a base end and an exercise end;

an exercise member attached to said exercise end; and, lever member attachment means for attaching one of said first and second lever member free ends to said base end thereby allowing said one of said lever members to be rotated about its hinge point by movement of said exercise member.

28. A hydraulic exercise apparatus as in claim 27, in which said extension member is a rigid beam.

29. A hydraulic exercise apparatus as in claim 27, in which said extension member is a flexible cable-type member.

30. A hydraulic exercise apparatus as in claim 23, in which said hydraulic resistance member comprises:

hydraulic pump means including an actuator for pumping fluid through a fluid circuit in response to a pumping movement of said actuator in such a manner that a force required to cause said pumping movement of said actuator is dependent upon a pressure of the fluid pumped;

a fluid circuit in fluid communication with said pump including first fluid valve means for allowing fluid to flow through a first portion of said circuit only when a fluid pressure at an upstream side of said valve means exceeds a selected pressure; and pressure selection means for determining said selected pressure in accordance with the position of said exercise member along said exercise stroke.

31. A hydraulic exercise apparatus as in claim 23, in which said hydraulic resistance member comprises:

a hydraulic cylinder including a housing and a piston within said housing, said piston and housing together defining a hydraulic chamber and a fluid port through which fluid may flow into and out of said chamber, the piston slidable within the housing such that a volume of the hydraulic chamber may be decreased and increased by movement of the piston to expel hydraulic fluid from the chamber or draw hydraulic fluid into the chamber, respectively, through said port;

a fluid circuit in fluid communication with said hydraulic passage for allowing fluid to flow from said chamber only when a fluid pressure in said chamber exceeds a selected pressure and allowing fluid to flow freely into said chamber when the volume of said chamber is increased; and pressure selection means for selecting said selected pressure in accordance with a position of said exercise member.

32. A hydraulic exercise apparatus comprising a support member having a longitudinal support member axis;

a carrier adapted to engage said support member and longitudinally movable along said support member;

releasable locking means for fixing a longitudinal position of said carrier along said support member axis;

first and second elongate lever members each of said lever members pivotally attached to said carrier at a carrier end such that said first and second lever members are pivotal in a common plane about their respective carrier ends, each of said lever members extending outwardly from said carrier to a distal actuator end, said first and second lever members embracing a hydraulic resistance member therebetween, said hydraulic resistance member having a first end and a second end, said first and second ends movable toward one another along a longitudinal resistance member axis when so urged by a force greater than a first selected force and movable away from one another along said axis when so urged by a force greater than a second selected force, said first and second ends pivotally attached to said first and second lever members, respectively, at a point lying between said carrier end and said actuator end; and immobilizing means for mobilizing one of said first and second lever members in a fixed position relative to said carrier.

33. A hydraulic exercise apparatus as in claim 32, further comprising a generally planar rectangular base panel, said support member has a base end and a top end, said base end pivotally attached to said base panel such that said longitudinal axis may pivot in a plane generally perpendicular to said base panel, and releasable locking means for releasably locking said support member with said longitudinal axis generally perpendicular to said base panel.

34. A hydraulic exercise apparatus as in claim 33, further comprising first and second end panels and first and second side panels each of said panels generally planar and of rectangular shape and having an inner and an outer edge, said outer edge generally parallel to said inner edge, a generally planar top panel of generally rectangular shape having a first and second end edge and first and second side edge, said first top panel end edge fixed to said first end panel outer edge such that said top panel is fixed in generally perpendicular relation to said first end panel, said base panel has first and second generally parallel end edges and first and second generally parallel side edges, said inner first and second end panel edges and said inner first and second side panel edges hingedly attached to said first and second end edges and first and second side edges of said base panel, respectively, such that said releasable locking means may be released and said support member rotated about its base end to bring its top end adjacent said bottom panel and said first and second end panels and said first and second side panels rotated inward about their inner edges to bring said first and second end panels, said first and second side panels and said top and bottom panels, respectively, into opposing relation to define a generally rectangular box enclosing said support member.

* * * * *